US012774826B2

(12) United States Patent
Pal et al.

(10) Patent No.: US 12,774,826 B2
(45) Date of Patent: Oct. 27, 2026

(54) METHODS AND SYSTEMS FOR OPERATING AN HVAC SYSTEM

(71) Applicant: Honeywell International Inc., Charlotte, NC (US)

(72) Inventors: Rohil Pal, Kanpur (IN); Aman Kumar Rai, Benares (IN); Vishwanath Gupta, Ranchi (IN); Banuprakash Balakrishna, Udupi (IN); Navneet Kumar, Gurgaon (IN); Deepika Sandeep, Bangalore (IN)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 556 days.

(21) Appl. No.: 18/343,538

(22) Filed: Jun. 28, 2023

(65) Prior Publication Data

US 2024/0003576 A1 Jan. 4, 2024

Related U.S. Application Data

(60) Provisional application No. 63/356,992, filed on Jun. 29, 2022.

(51) Int. Cl.
*F24F 11/65* (2018.01)

(52) U.S. Cl.
CPC ..... *F24F 11/65* (2018.01)

(58) Field of Classification Search
CPC ... Y02B 30/70; F24F 2110/50; F24F 2110/70; F24F 11/0001; F24F 11/30;
(Continued)

(56) References Cited

U.S. PATENT DOCUMENTS 7,881,889 B2 2/2011 Barclay et al.
9,569,804 B2 2/2017 Stein et al.
(Continued)

FOREIGN PATENT DOCUMENTS

CA 2520975 A1 4/2007
CN 113903474 A 12/2021
(Continued)

OTHER PUBLICATIONS

Cigler, et al; "Optimization of Predicted Mean Vote Index within Model Predictive Control Framework: Computationally Tractable Solution." Energy and Buildings 52, 39-49, (2012).
(Continued)

*Primary Examiner* — Darrin D Dunn
(74) *Attorney, Agent, or Firm* — Seager, Tufte & Wickhem, LLP

(57) ABSTRACT

Methods and systems for operating a Heating, Ventilating and Air Conditioning (HVAC) system in accordance with one of a plurality of operating modes. The plurality of operating modes include one or more of a health mode, an energy savings mode and a balanced mode. In some cases, the operating modes include two or more energy saving modes. The currently operating mode is selected based on the current operating conditions of the building and the desired goals of the building operator. The goals can include, for example, reducing energy usage, reducing pathogen risks, increasing air quality and/or a combination of these goals. In some cases, the operating modes are autonomously controlled. In some cases, the operating modes are manually controlled.

20 Claims, 26 Drawing Sheets

(58) Field of Classification Search
CPC ..... F24F 2110/64; F24F 11/64; F24F 11/65; F24F 2110/65; F24F 11/32; G05B 15/02; G05B 19/042; G05B 2219/2614
See application file for complete search history.

(56) References Cited

U.S. PATENT DOCUMENTS

| | | | | |
|---|---|---|---|---|
| 9,810,442 | B2 | 11/2017 | Matsuoka et al. | |
| 10,055,114 | B2 | 8/2018 | Shah et al. | |
| 10,578,522 | B2 * | 3/2020 | Zhang | F24F 11/74 |
| 10,731,885 | B2 | 8/2020 | Ajax et al. | |
| 10,928,084 | B2 | 2/2021 | Ajax et al. | |
| 11,131,473 | B2 | 9/2021 | Risbeck et al. | |
| 11,181,289 | B2 | 11/2021 | Federspiel et al. | |
| 11,209,177 | B2 | 12/2021 | Ito et al. | |
| 2013/0226359 | A1 * | 8/2013 | Ji | F24F 11/30 700/291 |
| 2015/0011154 | A1 * | 1/2015 | Holm | F24F 11/0001 454/258 |
| 2016/0116181 | A1 | 4/2016 | Aultman et al. | |
| 2021/0318010 | A1 | 10/2021 | Federspiel et al. | |
| 2021/0356153 | A1 * | 11/2021 | Nesler | F24F 11/46 |
| 2021/0398690 | A1 | 12/2021 | Gibson et al. | |
| 2022/0034542 | A1 | 2/2022 | Peters et al. | |
| 2022/0067851 | A1 | 3/2022 | Sinha et al. | |
| 2022/0154956 | A1 * | 5/2022 | Maruyama | F24F 11/52 |
| 2022/0228756 | A1 | 7/2022 | Gupta et al. | |
| 2023/0011991 | A1 * | 1/2023 | Xu | F24F 11/74 |
| 2023/0167995 | A1 * | 6/2023 | Sinur | F24F 11/0001 700/276 |
| 2024/0019158 | A1 * | 1/2024 | Murugesan | F24F 11/64 |
| 2024/0176319 | A1 * | 5/2024 | Risbeck | F24F 8/10 |

FOREIGN PATENT DOCUMENTS

| | | | |
|---|---|---|---|
| EP | 2805117 | A1 | 11/2014 |
| KR | 20100117409 | A | 11/2010 |
| KR | 20180059965 | A | 6/2018 |
| WO | 2022035876 | A1 | 2/2022 |
| WO | 2022040217 | A1 | 2/2022 |
| WO | 2022120158 | A1 | 6/2022 |

OTHER PUBLICATIONS

Cigler, et al; "On the Selection of the Most Appropriate MPC Problem Formulation for Buildings." In11th REHVA World Congress CLIMA 2013, No. CONF. 2013.
Walker, et al; "Application of Distributed Model Predictive Approaches to Temperature and CO2 Concentration Control in Buildings." IFAC—PapersOnLine50, No. 1 (2017): 2589-2594, 2017.
Iranmanesh et al; "Soft Switching Model Predictive Control with an Increase in the Security of Calculations and Information." J. Comput., 13(9), 1115-1126 (2018).
Drgona, et al; "All you need to know about Model Predictive Control for Buildings." Annual Reviews in Control (2020).
Chen et al; "Indoor Air Quality Monitoring System for Smart Buildings," UbiComp, Seattle, Washington, 5 pages, 2014.
Reset Pre-Release, 96 pages, 2017.
Mustapa et al., "Energy consumption prediction through linear and non-linear baseline energy model", vol. 17, No. 1, pp. 102-109, Jan. 2020.
Novelty Search Report, IDF-226505, pp. 1-15, Feb. 2022.
Touzani et al., "Gradiant boosting machine for modeling the energy consumption of commercial buildings", pp. 1-26, 2018.
Azimi et al., "Estimating the Nationwide Transmission of Measles in US Schools and Impacts of Vaccination and Supplemental Infection Control Strategies," BMC Infectious Diseases, vol. 20, Article No. 497, 85 pages, 2020.
Goyal et al., "Experimental Study of Occupancy-Based Control of HVAC Zones," Applied Energy, vol. 140, pp. 75-84, Applied Energy, vol. 140, pp. 75-84, 2015.
Pantelic et al., "A Preference Driven Multi-Criteria Optimization Tool for HVAC Design and Operation," Energy and Buildings, vol. 55, pp. 118-126, 2012.
Noakes et al., "Modeling Infection Risk and Energy Use of Upper Room Ultraviolet Germicidal Irradiation Systems in Multi-Room Environments," Science and Technology for the Built Environement, vol. 21, pp. 9-111, 2015.
Tang et al,. "Tempo-Spatial Infection Risk Assessment of Airborne Virus via CO2 Concentration Field Monitoring in Built Environment," Building and Environment, vol. 217, No. 1, 31 pages, Jun. 2022. Accessed Apr. 28, 2022.
U.S. Appl. No. 17/751,009, filed May 23, 2022.
U.S. Appl. No. 17/827,230, filed May 27, 2022.
Extended European Search Report, European Patent Office, EP Application No. 23180621.7, Nov. 24, 2023 (9 pages).

* cited by examiner

METHODS AND SYSTEMS FOR OPERATING AN HVAC SYSTEM

RELATED APPLICATIONS

This application claims the benefit of U.S. Provisional Patent Application Ser. No. 63/356,992, filed Jun. 29, 2022, which application is incorporated by reference herein.

TECHNICAL FIELD

The present disclosure relates to methods and systems for operating a Heating, Ventilating and Air Conditioning (HVAC) system.

BACKGROUND

HVAC systems provide conditioned air for heating and cooling the interior of a building. Some HVAC systems also can provide fresh air ventilation into the building while exhausting an equivalent amount of inside air. Such fresh air ventilation is useful in reducing contaminates produced in the building. However, there are often costs involved in conditioning the fresh air before it can be deployed in the building. For example, in the winter, the cold fresh air must typically be heated by the HVAC system, and in some cases, humidity must be added. Likewise, in the summer, the warm fresh air must typically be cooled by the HVAC system, and in some cases, humidity must be removed. Thus, to reduce operating costs, it is often desirable to minimize the ventilation rate while still adequately ventilating the building given the current contaminates or expected contaminates in the building.

Under some conditions, such as during a pandemic, it may be desirable to prioritize an increased ventilation rate over energy costs to help reduce the spread of pathogens within the building. Under these conditions, if the ventilation rate is set too high, given the current indoor and outdoor conditions, the HVAC system may lack the heating and/or cooling capacity to adequately condition the incoming fresh air while still maintaining occupant comfort in the building. What would be desirable are methods and systems for operating an HVAC system to provide adequate ventilation while minimizing energy usage and maintaining comfort.

SUMMARY

The present disclosure relates to methods and systems for operating an HVAC system that services a building space. An example method includes sensing one or more sensed values and automatically selecting an operating mode of the HVAC system from a plurality of operating modes based at least in part on one or more of the sensed values. The plurality of operating modes include, for example, a health mode that when selected attempts to maximize ventilation to the building space subject to one or more constraints including a constraint of maintaining one or more comfort conditions in the building space, a first energy savings mode that attempts to minimize energy consumed by the HVAC system to condition air supplied to the building space subject to one or more constraints including a constraint of maintaining one or more comfort conditions in the building space and a constraint to maintain IAQ contaminants in the building space below one or more first IAQ thresholds, and a second energy savings mode that attempts to minimize energy consumed by the HVAC system to condition air supplied to the building space subject to one or more constraints including a constraint of maintaining one or more comfort conditions in the building space and a constraint to maintain IAQ contaminants in the building space below one or more second IAQ thresholds, wherein the one or more second IAQ thresholds are less stringent than the one or more first IAQ thresholds. The example method includes controlling one or more components of the HVAC system in accordance with the selected operating mode.

Another example may be found in a method for operating a Heating, Ventilating and Air Conditioning (HVAC) system that services a building space. The method includes predicting a ventilation setpoint for a fresh air intake of the HVAC system that provides ventilation to the building space using a ventilation setpoint prediction algorithm. An energy consumption baseline of the HVAC system is predicted with the fresh air intake at the predicted ventilation setpoint. A concentration of one or more IAQ contaminates in the building space is predicted with the fresh air intake at the predicted ventilation setpoint. The fresh air intake of the HVAC system is controlled to the predicted ventilation setpoint. With the fresh air intake of the HVAC system at the predicted ventilation setpoint, a residual between the predicted concentration of one or more IAQ contaminates and a measured concentration of one or more IAQ contaminates in the building space is determined. The residual between the predicted concentration of one or more IAQ contaminates and the measured concentration of one or more IAQ contaminates is fed back to the ventilation setpoint prediction algorithm, wherein the ventilation setpoint prediction algorithm uses the residual to improve prediction accuracy of the ventilation setpoint over time.

Another example may be found in a method for operating a Heating, Ventilating and Air Conditioning (HVAC) system that services a building space. The method includes storing a building model for the building space. The building model includes a representation of how one or more environmental parameters associated with the building space is predicted to respond to changes in HVAC system operation under a plurality of different operating conditions and how an energy consumption baseline of the HVAC system is predicted to respond to changes in HVAC system operation under a plurality of different operating conditions. A current operating condition is identified and a current energy usage baseline of the HVAC system is determined under the current operation condition using the building model. A ventilation setpoint for a fresh air intake of the HVAC system that provides ventilation to the building space is determined based at least in part on the current energy usage baseline. The fresh air intake of the HVAC system is controlled to the ventilation setpoint.

The preceding summary is provided to facilitate an understanding of some of the innovative features unique to the present disclosure and is not intended to be a full description. A full appreciation of the disclosure can be gained by taking the entire specification, claims, figures, and abstract as a whole.

BRIEF DESCRIPTION OF THE FIGURES

The disclosure may be more completely understood in consideration of the following description of various examples in connection with the accompanying drawings, in which.

Figure 1:
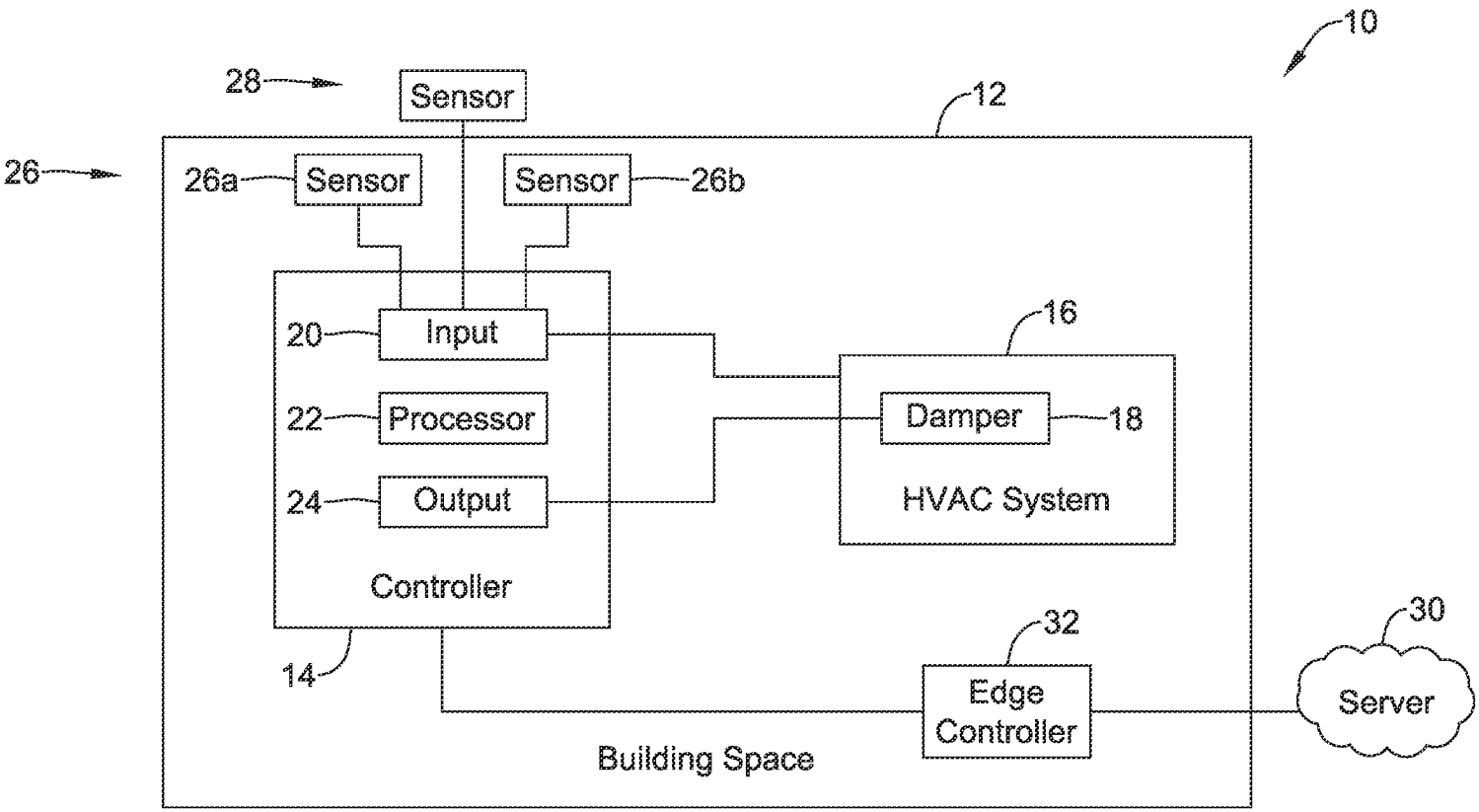
FIG. 1 is a schematic block diagram of an illustrative HVAC control system.

While the disclosure is amenable to various modifications and alternative forms, specifics thereof have been shown by way of example in the drawings and will be described in detail. It should be understood, however, that the intention is not to limit the disclosure to the particular examples described. On the contrary, the intention is to cover all modifications, equivalents, and alternatives falling within the spirit and scope of the disclosure.

Description

The following description should be read with reference to the drawings, in which like elements in different drawings are numbered in like fashion. The drawings, which are not necessarily to scale, depict examples that are not intended to limit the scope of the disclosure. Although examples are illustrated for the various elements, those skilled in the art will recognize that many of the examples provided have suitable alternatives that may be utilized.

All numbers are herein assumed to be modified by the term "about", unless the content clearly dictates otherwise. The recitation of numerical ranges by endpoints includes all numbers subsumed within that range (e.g., 1 to 5 includes 1, 1.5, 2, 2.75, 3, 3.80, 4, and 5).

As used in this specification and the appended claims, the singular forms "a", "an", and "the" include the plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is contemplated that the feature, structure, or characteristic is described in connection with an embodiment, it is contemplated that the feature, structure, or characteristic may be applied to other embodiments whether or not explicitly described unless clearly stated to the contrary.

FIG. 1 is a schematic block diagram of an illustrative HVAC control system 10. In the example shown, a building space 12 includes a controller 14 that is configured to control at least some features and operations of an HVAC system 16. The building space 12 may represent the interior of an entire building, or only part of a building. The controller 14 may control operation of a damper 18 that is part of the HVAC system 16 and that functions to control the relative flow of fresh outside air into the building space 12 through the ductwork (not shown) that provides conditioned air to various parts of the building space 12. The controller 14 may control other features and components of the HVAC system 16 as well. The controller 14 may operate in accordance with various HVAC standards such as but not limited to ASHRAE 62.1 to provide appropriate volumes of fresh air to the building space 12. Providing fresh air can provide the interior of the building space 12 with healthier air that contains relatively less of various contaminants than the interior air in the building space 12 would otherwise have, as outdoor air can be substantially cleaner than indoor air. Providing fresh air can also help with comfort, such as if the building space 12 is currently warmer than a temperature setpoint but the outside air is cool enough that it can be used to help cool the building space 12 down to its temperature setpoint. This is just an example.

The illustrative controller 14 includes an input 20 for receiving one or more interior environmental conditions within the building space 12 as well as for receiving one or more exterior environmental conditions outside of the building space 12. The input 20 may also receive one or more operating conditions of the HVAC system 16 over time. In the example shown, the controller 14 includes a processor 22 that is operatively coupled to the input 20 such that the processor 22 can track over time one or more environmental conditions within the building space 12 and also track over time one or more exterior environmental conditions outside of the building space 12. The processor 22 may also track one or more operating conditions of the HVAC system 16 over time, and correlate in time the one or more operating conditions of the HVAC system 16 with the one or more environmental conditions within the building space 12, the one or more exterior environmental conditions outside of the building space 12, and/or any other suitable conditions or parameters. While a single processor 22 is shown, it will be appreciated that the controller 14 may include two, three or more distinct processors 22. In cases where the controller 14 includes multiple processors 22, the functionality of the controller 14 may be divided between the two, three or more distinct processors 22, and in some cases, may be distributed amount a plurality of different locations.

In the example shown, the processor 22 may be configured to learn an environmental model for the building space 12 based at least in part on the tracked one or more interior environmental conditions within the building space 12 and the one or more exterior environmental conditions outside of the building space 12 during operation of the HVAC system 16. The learned environmental model is configured to predict an environmental state of the building space 12 in response to operation of the HVAC system 16 under various interior and exterior environmental conditions. The processor 22 may be configured to determine a dynamic ventilation rate for the HVAC system 16 of the building space 12 based at least in part on inputting to the environmental model of the building space 12 one or more current interior environmental conditions and one or more current exterior environmental conditions. The illustrative controller 14 further includes an output 24 for sending the determined dynamic ventilation rate to the HVAC system 16 for controlling the outdoor air ventilation damper 18 of the HVAC system 16.

In some cases, the processor 22 is configured to predict a current maximum allowed ventilation rate that can be achieved without causing the HVAC system 26 to compromise on any of one or more comfort conditions of the building space. The HVAC system 16 may control the outdoor air ventilation damper 18 to provide ventilation up to or at the current maximum allowed ventilation rate.

In the example shown, the building space 12 may include one or more sensors 26, individually labeled as 26*a* and 26*b*. While two sensors 26 are shown, it will be appreciated that this is merely illustrative, as the building space 12 may include any number of sensors 26, and may include only one sensor 26 or may include three, four, five or even substantially more sensors 26. At least some of the sensors 26 may be hard-wired to the input 20. At least some of the sensors 26 may be wirelessly coupled to the input 20. The sensors 26 may represent any of a variety of different types of sensors. The sensors 26 may be configured to provide signals representing one or more interior environmental conditions to the input 20. The sensors 26 may include temperature sensors, humidity sensors, $CO_2$ sensors and sensors configured to detect other indoor pollutants such as particulate matter (PM), volatile organic compounds (VOCs) and the like. The sensors 26 may include occupancy sensors, such as motion sensors, video camera sensors coupled with video analytics that in some cases can identify and maintain a count and/or density of people in the building space, a time of flight (e.g. LIDAR) sensor that can detect and in some cases maintain a count and/or density of people in the building space, a milli-meter wave sensor (e.g. Radar) that can detect and in some cases maintain a count and/or density of people in the building space, and/or any other suitable sensor as desired. People are known to produce contaminates in the building space. The sensors 26 may include an energy usage sensor, such as an energy meter, for providing a measure of energy usage by the building, and more particularly, by the HVAC system of the building. In some cases, a plurality of energy usage sensors may be provided, such as an electricity usage meter and a natural gas usage meter. These are just examples.

The illustrative HVAC control system 10 also includes one or more sensors 28 that are disposed outside of the building space 12 in order to provide signals representing one or more exterior environmental conditions to the input 20. At least some of the sensors 28 may be hard-wired to the input 20. At least some of the sensors 28 may be wirelessly coupled to the input 20. In some cases, the sensors 28 are accessed from a weather service via a suitable Application Programming Interface (API). These are just examples. The sensors 28 may include temperature sensors, humidity sensors, $CO_2$ sensors and sensors configured to detect other pollutants such as particulate matter (PM), volatile organic compounds (VOCs) and the like.

In some instances, the controller 14 may communicate with a remote server 30. The remote server 30 may be a cloud-based server, for example. An edge controller 32 may provide a go-between between the controller 14 and the remote server 30. The controller 14 may provide data to the remote server 30 for performance monitoring, for example. As discussed thus far, the processor 22 within the controller 14 receives various inputs from the interior sensors 26 and the exterior sensors 28, and may receive various inputs such as HVAC operational conditions from the HVAC system 16. The processor 22 may use these various inputs to learn an environmental model for the building space 12, sometimes using Artificial Intelligence and/or Machine Learning. In other cases, the processor 22 may simply receive the various inputs from the input 20 and forward the information to the output 24 for transmission to either the edge controller 32 itself or ultimately the remote server 30 for processing. In some cases, the processing power that monitors the various inputs and creates and maintains the learned environmental model for the building space 12 may reside within the edge controller 32. In such cases, the edge controller 32 may include one or more containers in which the processing power is manifested. In some cases, the edge controller 32 merely functions as a gateway, providing the information to the remote server 30, where the processing power that monitors the various inputs and creates and maintains the learned environmental model for the building space 12 resides. In some cases, the processing power that monitors the various inputs and creates and maintains the learned environmental model for the building space 12 is distributed throughout the HVAC control system 10, the edge controller 32 and/or the remote server 30. These are just examples.

In some cases, the learned environmental model is not static, but is repeatedly updated to account for changes in the HVAC control system 10. These changes can include normal changes resulting from components of the HVAC control system 10 aging. An example is a filter that allows a decreasing air flow as the filter becomes clogged. Another example may be a variation in fan speed caused by a belt that drives the fan stretching as it ages. Heat exchangers can lose efficiency over time. The building space 12 itself may change over time. For example, windows may start to leak additional air as weather stripping on the windows ages and contracts. Alternatively, window efficiency may increase if old windows are replaced. HVAC system efficiency may increase when particular parts of the HVAC system are replaced. These are just examples of situations in which the learned environmental model is updated to account for changes in the environment.

Figure 2:
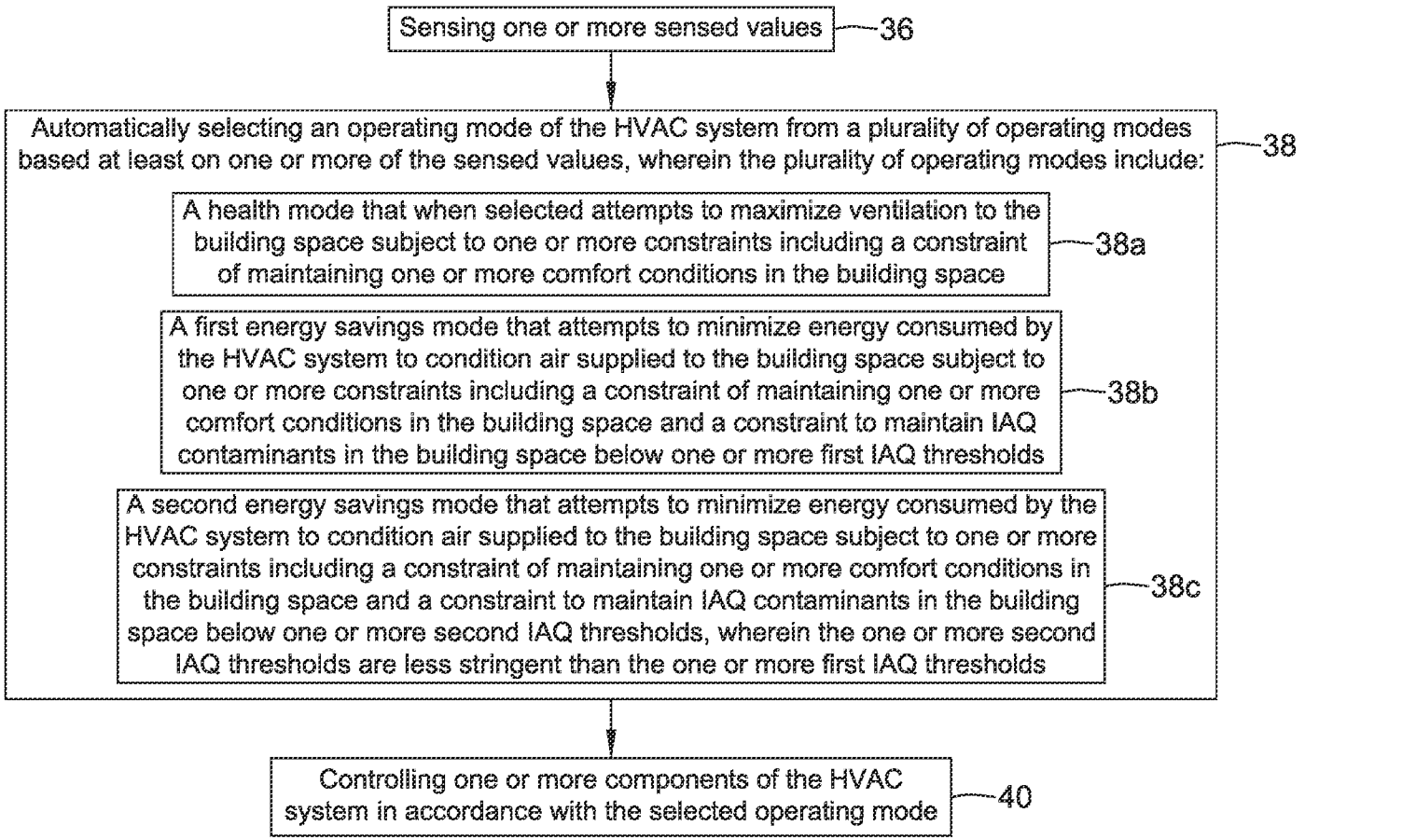
FIG. 2 is a flow diagram showing an illustrative method for operating the illustrative HVAC control system of FIG. 1.

FIG. 2 is a flow diagram showing an illustrative method 34 for operating the HVAC control system 10. The illustrative method 34 includes sensing one or more sensed values, as indicated at block 36. The one or more sensed values may include two or more of an energy meter reading value, an indoor temperature value, an outdoor temperature value, an indoor humidity value, an outdoor humidity value, an indoor dew point value, an outdoor dew point value, a pressure value, an indoor $CO_2$ value, an outdoor $CO_2$ value, an indoor PM2.5 value, an outdoor PM2.5 value, an indoor TVOC value, an outdoor TVOC value, and an occupancy count value.

In some cases, an operating mode of the HVAC system is automatically selected from a plurality of operating modes based at least in part on one or more of the sensed values, as indicated at block 38. The plurality of operating modes include a health mode that when selected attempts to maximize ventilation to the building space subject to one or more constraints including a constraint of maintaining one or more comfort conditions in the building space, as indicated at block 38*a*. The plurality of operating modes include a first energy savings mode that attempts to minimize energy consumed by the HVAC system to condition air supplied to the building space subject to one or more constraints including a constraint of maintaining one or more comfort conditions in the building space and a constraint to maintain IAQ contaminants in the building space below one or more first IAQ thresholds, as indicated at block 38*b*. The plurality of operating modes include a second energy savings mode that attempts to minimize energy consumed by the HVAC system to condition air supplied to the building space subject to one or more constraints including a constraint of maintaining one or more comfort conditions in the building space and a constraint to maintain IAQ contaminants in the building space below one or more second IAQ thresholds, wherein the one or more second IAQ thresholds are less stringent than the one or more first IAQ thresholds, as indicated at block 38*c*. These are example operating modes of the HVAC system. One or more components of the HVAC system are controlled in accordance with the selected operating mode, as indicated at block 40.

The plurality of operating modes may include a third energy savings mode that attempts to minimize energy consumed by the HVAC system to condition air supplied to the building space subject to one or more constraints including a constraint of maintaining one or more comfort conditions in the building space and a constraint to maintain IAQ contaminants in the building space below one or more third IAQ thresholds, wherein the one or more third IAQ thresholds are less stringent than the one or more second IAQ thresholds. The plurality of operating modes may further include a fourth energy savings mode that attempts to minimize energy consumed by the HVAC system to condition air supplied to the building space subject to one or more constraints including a constraint of maintaining one or more comfort conditions in the building space and a constraint to maintain IAQ contaminants in the building space below one or more fourth IAQ thresholds, wherein the one or more fourth IAQ thresholds are less stringent than the one or more third IAQ thresholds. In some cases, the IAQ contaminants may include $CO_2$, PM2.5 and TVOC, each with a corresponding first IAQ threshold and a corresponding second IAQ threshold.

In some cases, the plurality of operating modes include a balanced mode that when selected attempts to control ventilation to the building space to maintain IAQ contaminants in the building space below one or more balance mode IAQ thresholds subject to one or more constraints including a constraint of maintaining one or more comfort conditions in the building space.

In some cases, when operating in one or more of the energy savings modes, the illustrative method 34 may include increasing ventilation to the building space at times when ventilation has a reduced impact on energy consumed by the HVAC system, and decreasing ventilation to the building space at times when ventilation has an increased impact on energy consumed by the HVAC system. In some cases, when operating in one or more of the energy savings modes, the method 34 may include increasing ventilation to the building space at times when one or more outdoor air parameters have a reduced impact on energy consumed by the HVAC system and/or an increased impact on reducing concentrations of one or more IAQ contaminates in the building space. The method 34 may include decreasing ventilation to the building space at times when one or more outdoor air parameters have an increased impact on energy consumed by the HVAC system and/or a decreased impact on reducing concentrations of one or more IAQ contaminates in the building space.

Figure 3:
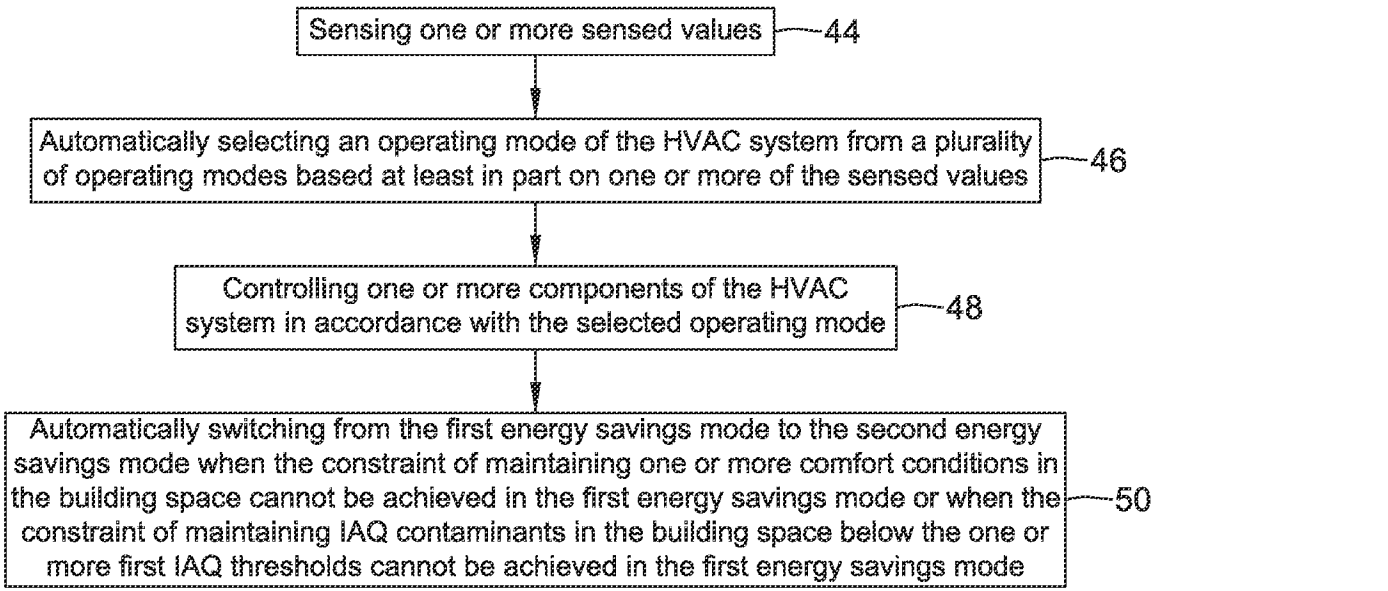
FIG. 3 is a flow diagram showing an illustrative method for operating the illustrative HVAC control system of FIG. 1.

FIG. 3 is a flow diagram showing an illustrative method 42 for operating the HVAC control system 10. The illustrative method 42 includes sensing one or more sensed values, as indicated at block 44. The one or more sensed values may include two or more of an energy meter reading value, an indoor temperature value, an outdoor temperature value, an indoor humidity value, an outdoor humidity value, an indoor dew point value, an outdoor dew point value, a pressure value, an indoor $CO_2$ value, an outdoor $CO_2$ value, an indoor PM2.5 value, an outdoor PM2.5 value, an indoor TVOC value, an outdoor TVOC value, and an occupancy value.

An operating mode of the HVAC system is automatically selected from a plurality of operating modes based at least in part on one or more of the sensed values, as indicated at block 46. The plurality of operating modes include a health mode that when selected attempts to maximize ventilation to the building space subject to one or more constraints including a constraint of maintaining one or more comfort conditions in the building space. The plurality of operating modes include a first energy savings mode that attempts to minimize energy consumed by the HVAC system to condition air supplied to the building space subject to one or more constraints including a constraint of maintaining one or more comfort conditions in the building space and a constraint to maintain IAQ contaminants in the building space below one or more first IAQ thresholds. The plurality of operating modes include a second energy savings mode that attempts to minimize energy consumed by the HVAC system to condition air supplied to the building space subject to one or more constraints including a constraint of maintaining one or more comfort conditions in the building space and a constraint to maintain IAQ contaminants in the building space below one or more second IAQ thresholds, wherein the one or more second IAQ thresholds are less stringent than the one or more first IAQ thresholds.

In some cases, the plurality of operating modes may include a third energy savings mode that attempts to minimize energy consumed by the HVAC system to condition air supplied to the building space subject to one or more constraints including a constraint of maintaining one or more comfort conditions in the building space and a constraint to maintain IAQ contaminants in the building space below one or more third IAQ thresholds, wherein the one or more third IAQ thresholds are less stringent than the one or more second IAQ thresholds. The plurality of operating modes may further include a fourth energy savings mode that attempts to minimize energy consumed by the HVAC system to condition air supplied to the building space subject to one or more constraints including a constraint of maintaining one or more comfort conditions in the building space and a constraint to maintain IAQ contaminants in the building space below one or more fourth IAQ thresholds, wherein the one or more fourth IAQ thresholds are less stringent than the one or more third IAQ thresholds. In some cases, the IAQ contaminants may include $CO_2$, PM2.5 and TVOC, each with a corresponding first IAQ threshold and a corresponding second IAQ threshold.

In some cases, the plurality of operating modes include a balanced mode that when selected attempts to control ventilation to the building space to maintain IAQ contaminants in the building space below one or more balance mode IAQ thresholds subject to one or more constraints including a constraint of maintaining one or more comfort conditions in the building space.

In some cases, when operating in one or more of the energy savings modes, the method 42 may include increasing ventilation to the building space at times when ventilation has a reduced impact on energy consumed by the HVAC system, and decreasing ventilation to the building space at times when ventilation has an increased impact on energy consumed by the HVAC system. In some cases, when operating in one or more of the energy savings modes, the method 34 may include increasing ventilation to the building space at times when one or more outdoor air parameters have a reduced impact on energy consumed by the HVAC system and/or an increased impact on reducing concentrations of one or more IAQ contaminates in the building space. The method 42 may include decreasing ventilation to the building space at times when one or more outdoor air parameters have an increased impact on energy consumed by the HVAC system and/or a decreased impact on reducing concentrations of one or more IAQ contaminates in the building space.

One or more components of the HVAC system are controlled in accordance with the selected operating mode, as indicated at block 48. In some cases, the method 42 may include automatically switching from the first energy savings mode to the second energy savings mode when the constraint of maintaining one or more comfort conditions in the building space cannot be achieved in the first energy savings mode or when the constraint of maintaining IAQ contaminants in the building space below the one or more first IAQ thresholds cannot be achieved in the first energy savings mode, as indicated at block 50. Switching between the other operating modes may also be automatically controlled. In some cases, switching between the other operating modes may be manually controlled by a user.

Figure 4A:
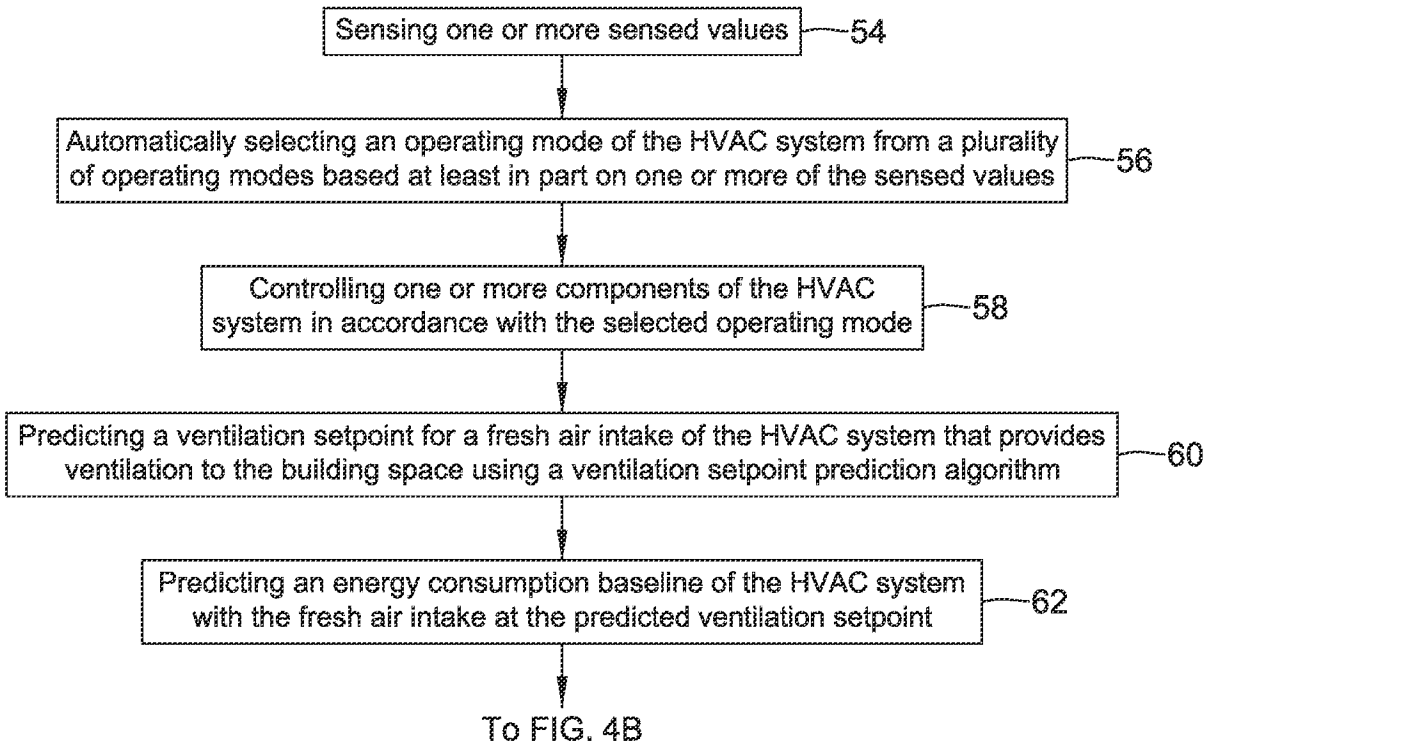
FIGS. 4A and 4B are flow diagrams that together show an illustrative method for operating the illustrative HVAC control system of FIG. 1.
Figure 4B:
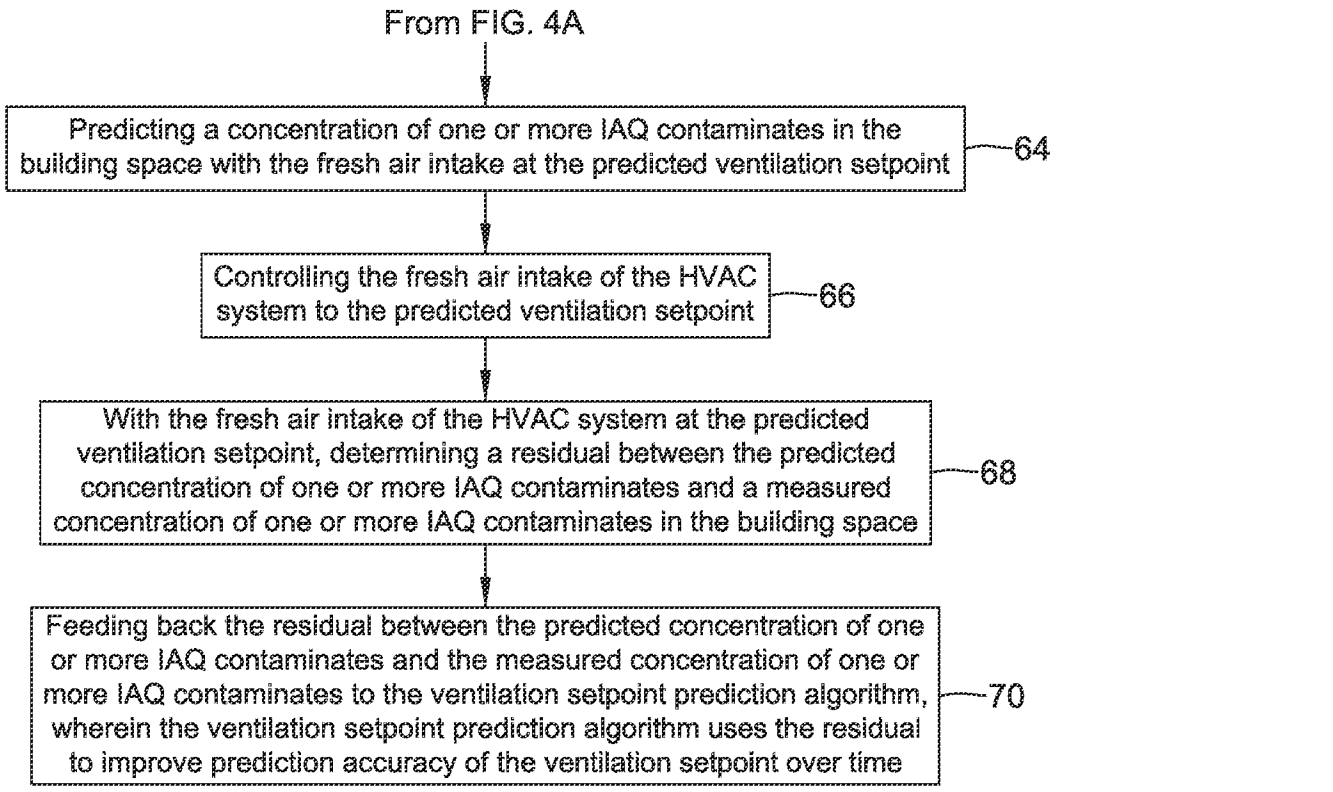

FIGS. 4A and 4B are flow diagrams that together show an illustrative method 52 for operating the HVAC control system 10. The illustrative method 52 includes sensing one or more sensed values, as indicated at block 54. The one or more sensed values may include two or more of an energy meter reading value, an indoor temperature value, an outdoor temperature value, an indoor humidity value, an outdoor humidity value, an indoor dew point value, an outdoor dew point value, a pressure value, an indoor $CO_2$ value, an outdoor $CO_2$ value, an indoor PM2.5 value, an outdoor PM2.5 value, an indoor TVOC value, an outdoor TVOC value, and an occupancy value.

In some cases, an operating mode of the HVAC system is automatically selected from a plurality of operating modes based at least in part on one or more of the sensed values, as indicated at block 56. The plurality of operating modes include a health mode that when selected attempts to maximize ventilation to the building space subject to one or more constraints including a constraint of maintaining one or more comfort conditions in the building space. The plurality of operating modes include a first energy savings mode that attempts to minimize energy consumed by the HVAC system to condition air supplied to the building space subject to one or more constraints including a constraint of maintaining one or more comfort conditions in the building space and a constraint to maintain IAQ contaminants in the building space below one or more first IAQ thresholds. The plurality of operating modes include a second energy savings mode that attempts to minimize energy consumed by the HVAC system to condition air supplied to the building space subject to one or more constraints including a constraint of maintaining one or more comfort conditions in the building space and a constraint to maintain IAQ contaminants in the building space below one or more second IAQ thresholds, wherein the one or more second IAQ thresholds are less stringent than the one or more first IAQ thresholds.

In some cases, the plurality of operating modes may further include a third energy savings mode that attempts to minimize energy consumed by the HVAC system to condition air supplied to the building space subject to one or more constraints including a constraint of maintaining one or more comfort conditions in the building space and a constraint to maintain IAQ contaminants in the building space below one or more third IAQ thresholds, wherein the one or more third IAQ thresholds are less stringent than the one or more second IAQ thresholds. The plurality of operating modes may further include a fourth energy savings mode that attempts to minimize energy consumed by the HVAC system to condition air supplied to the building space subject to one or more constraints including a constraint of maintaining one or more comfort conditions in the building space and a constraint to maintain IAQ contaminants in the building space below one or more fourth IAQ thresholds, wherein the one or more fourth IAQ thresholds are less stringent than the one or more third IAQ thresholds. In some cases, the IAQ contaminants may include $CO_2$, PM2.5 and TVOC, each with a corresponding first IAQ threshold and a corresponding second IAQ threshold.

In some cases, the plurality of operating modes include a balanced mode that when selected attempts to control ventilation to the building space to maintain IAQ contaminants in the building space below one or more balance mode IAQ thresholds subject to one or more constraints including a constraint of maintaining one or more comfort conditions in the building space.

In some cases, when operating in one or more of the energy savings modes, the method 42 may include increasing ventilation to the building space at times when ventilation has a reduced impact on energy consumed by the HVAC system, and decreasing ventilation to the building space at times when ventilation has an increased impact on energy consumed by the HVAC system. In some cases, when operating in one or more of the energy savings modes, the method 34 may include increasing ventilation to the building space at times when one or more outdoor air parameters have a reduced impact on energy consumed by the HVAC system and/or an increased impact on reducing concentrations of one or more IAQ contaminates in the building space. The method 42 may include decreasing ventilation to the building space at times when one or more outdoor air parameters have an increased impact on energy consumed by the HVAC system and/or a decreased impact on reducing concentrations of one or more IAQ contaminates in the building space.

One or more components of the HVAC system are controlled in accordance with the selected operating mode, as indicated at block 58. A ventilation setpoint for a fresh air intake of the HVAC system that provides ventilation to the building space is predicted using a ventilation setpoint prediction algorithm, as indicated at block 60. An energy consumption baseline of the HVAC system is predicted with the fresh air intake at the predicted ventilation setpoint, as indicated at block 62.

Continuing on FIG. 4B, the method 52 continues with predicting a concentration of one or more IAQ contaminates in the building space with the fresh air intake at the predicted ventilation setpoint, as indicated at block 64. The fresh air intake of the HVAC system is controlled to the predicted ventilation setpoint, as indicated at block 66. With the fresh air intake of the HVAC system at the predicted ventilation setpoint, determining a residual between the predicted concentration of one or more IAQ contaminates and a measured concentration of one or more IAQ contaminates in the building space is determined, as indicated at block 68. The residual between the predicted concentration of one or more IAQ contaminates and the measured concentration of one or more IAQ contaminates is fed back to the ventilation setpoint prediction algorithm, wherein the ventilation setpoint prediction algorithm uses the residual to improve prediction accuracy of the ventilation setpoint over time, as indicated at block 70.

Figure 5:
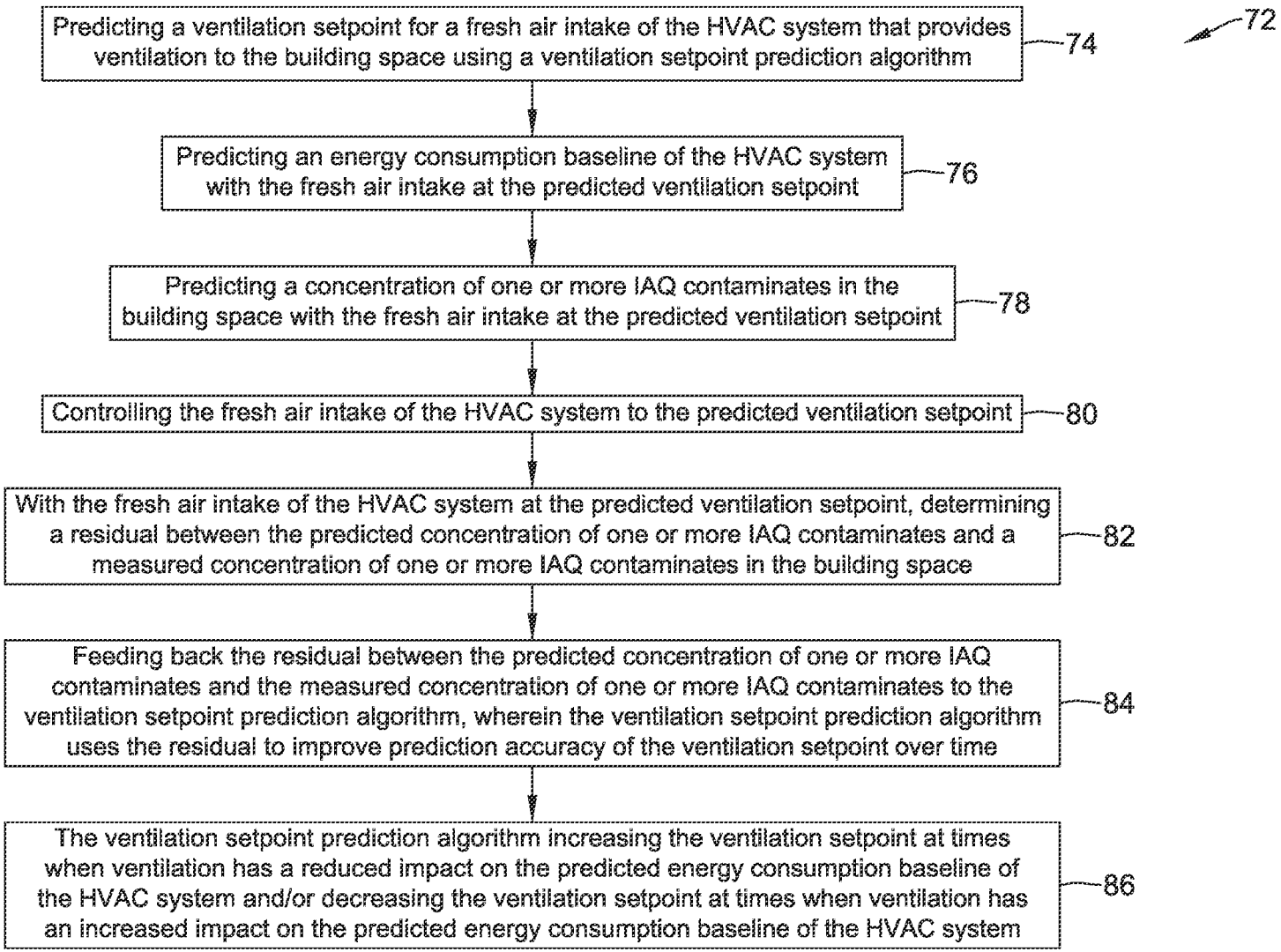
FIG. 5 is a flow diagram showing an illustrative method for operating the illustrative HVAC control system of FIG. 1.

FIG. 5 is a flow diagram showing an illustrative method 72 for operating the HVAC control system 10. The illustrative method 72 includes predicting a ventilation setpoint for a fresh air intake of the HVAC system that provides ventilation to the building space using a ventilation setpoint prediction algorithm, as indicated at block 74. An energy consumption baseline of the HVAC system is predicted with the fresh air intake at the predicted ventilation setpoint, as indicated at block 76. A concentration of one or more IAQ contaminates in the building space is predicted with the fresh air intake at the predicted ventilation setpoint, as indicated at block 78. The fresh air intake of the HVAC system is controlled to the predicted ventilation setpoint, as indicated at block 80. In some cases, the building model discussed herein may be used to predict the ventilation setpoint, the energy consumption baseline and the concentration of one or more IAQ contaminates, sometimes using Artificial Intelligence (AI) and/or Machine Learning (ML).

With the fresh air intake of the HVAC system at the predicted ventilation setpoint, a residual between the predicted concentration of one or more IAQ contaminates and a measured concentration of one or more IAQ contaminates in the building space is determined, as indicated at block 82. The residual between the predicted concentration of one or more IAQ contaminates and the measured concentration of one or more IAQ contaminates is fed back to the ventilation setpoint prediction algorithm, wherein the ventilation setpoint prediction algorithm uses the residual to improve prediction accuracy of the ventilation setpoint over time, as indicated at block 84. In some cases, the ventilation setpoint prediction algorithm uses Artificial Intelligence (AI) and/or Machine Learning (ML) to improve prediction accuracy of the ventilation setpoint over time.

In some cases, the method 72 includes the ventilation setpoint prediction algorithm increasing the ventilation setpoint at times when ventilation has a reduced impact on the predicted energy consumption baseline of the HVAC system and/or the ventilation setpoint prediction algorithm decreasing the ventilation setpoint at times when ventilation has an increased impact on the predicted energy consumption baseline of the HVAC system, as indicated at block 86.

Figure 6A:
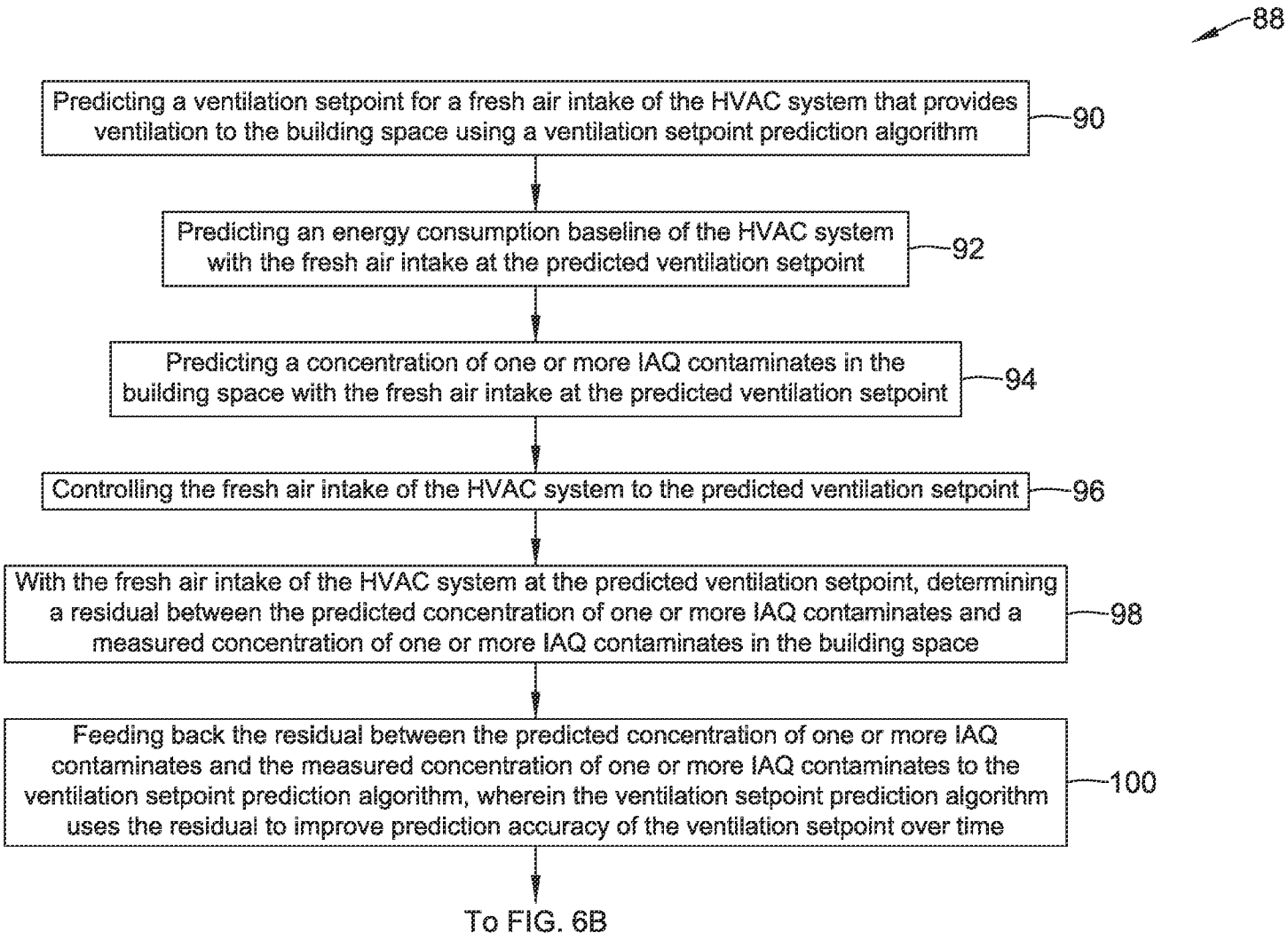
FIGS. 6A and 6B are flow diagrams that together show an illustrative method for operating the illustrative HVAC control system of FIG. 1.
Figure 6B:
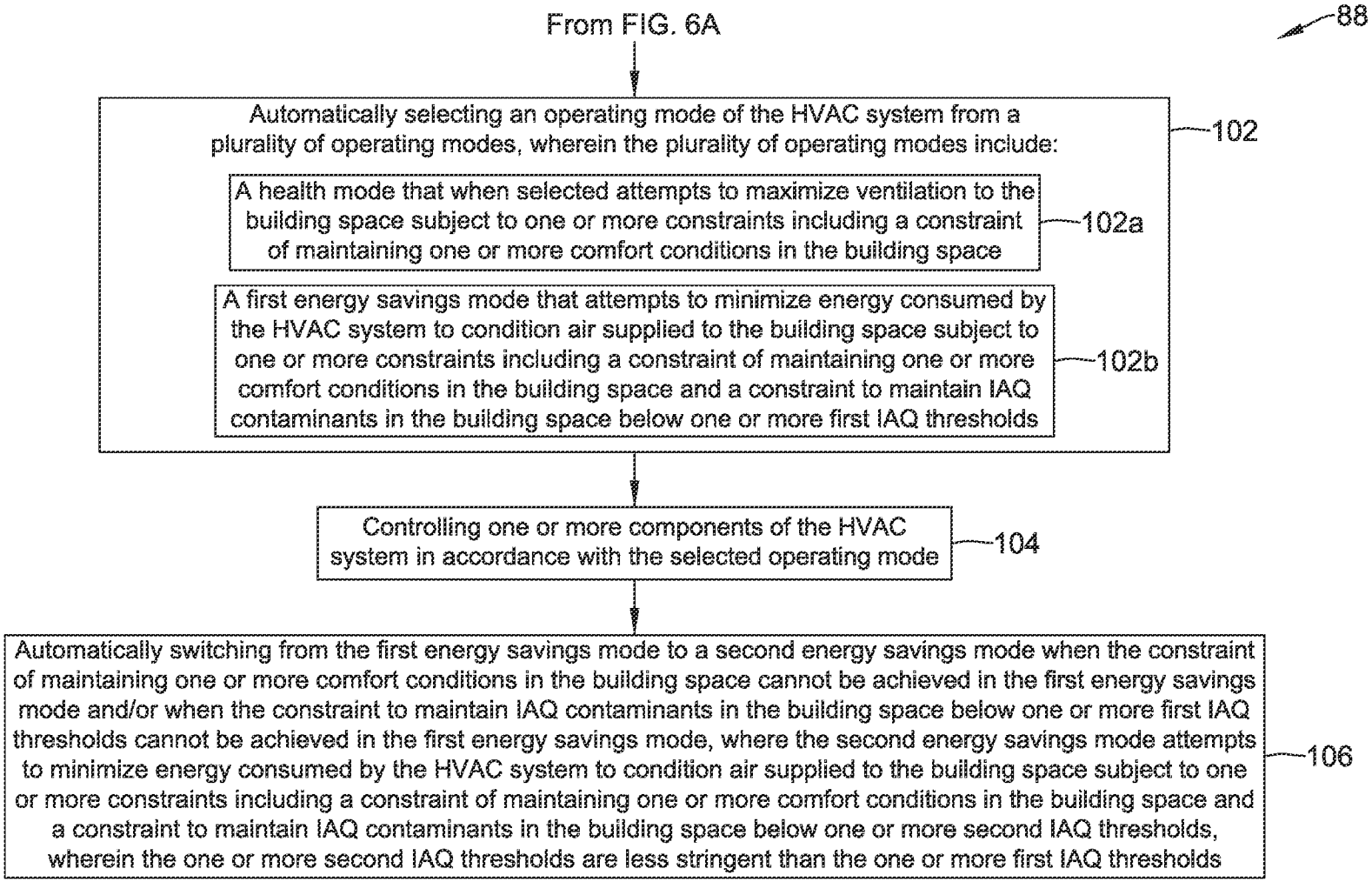

FIGS. 6A and 6B are flow diagrams that together show an illustrative method 88 for operating the HVAC control system 10. The illustrative method 88 includes predicting a ventilation setpoint for a fresh air intake of the HVAC system that provides ventilation to the building space using a ventilation setpoint prediction algorithm, as indicated at block 90. An energy consumption baseline of the HVAC system is predicted with the fresh air intake at the predicted ventilation setpoint, as indicated at block 92. A concentration of one or more IAQ contaminates in the building space is predicted with the fresh air intake at the predicted ventilation setpoint, as indicated at block 94. The fresh air intake of the HVAC system is controlled to the predicted ventilation setpoint, as indicated at block 96.

With the fresh air intake of the HVAC system at the predicted ventilation setpoint, a residual between the predicted concentration of one or more IAQ contaminates and a measured concentration of one or more IAQ contaminates in the building space is determined, as indicated at block 98. The residual between the predicted concentration of one or more IAQ contaminates and the measured concentration of one or more IAQ contaminates is fed back to the ventilation setpoint prediction algorithm, wherein the ventilation setpoint prediction algorithm uses the residual to improve prediction accuracy of the ventilation setpoint over time, as indicated at block 100. In some cases, the ventilation setpoint prediction algorithm uses machine learning to improve prediction accuracy of the ventilation setpoint over time.

The method 88 continues on FIG. 6B with automatically selecting an operating mode of the HVAC system from a plurality of operating modes, as indicated at block 102. The plurality of operating modes include a health mode that when selected attempts to maximize ventilation to the building space subject to one or more constraints including a constraint of maintaining one or more comfort conditions in the building space, as indicated at block 102*a*. The plurality of operating modes include a first energy savings mode that attempts to minimize energy consumed by the HVAC system to condition air supplied to the building space subject to one or more constraints including a constraint of maintaining one or more comfort conditions in the building space and a constraint to maintain IAQ contaminants in the building space below one or more first IAQ thresholds, as indicated at block 102*b*. One or more components of the HVAC system are controlled in accordance with the selected operating mode, as indicated at block 104.

In some cases, the method 88 may include automatically switching from the first energy savings mode to a second energy savings mode when the constraint of maintaining one or more comfort conditions in the building space cannot be achieved in the first energy savings mode and/or when the constraint to maintain IAQ contaminants in the building space below one or more first IAQ thresholds cannot be achieved in the first energy savings mode, where the second energy savings mode attempts to minimize energy consumed by the HVAC system to condition air supplied to the building space subject to one or more constraints including a constraint of maintaining one or more comfort conditions in the building space and a constraint to maintain IAQ contaminants in the building space below one or more second IAQ thresholds, wherein the one or more second IAQ thresholds are less stringent than the one or more first IAQ thresholds, as indicated at block 106.

Figure 7:
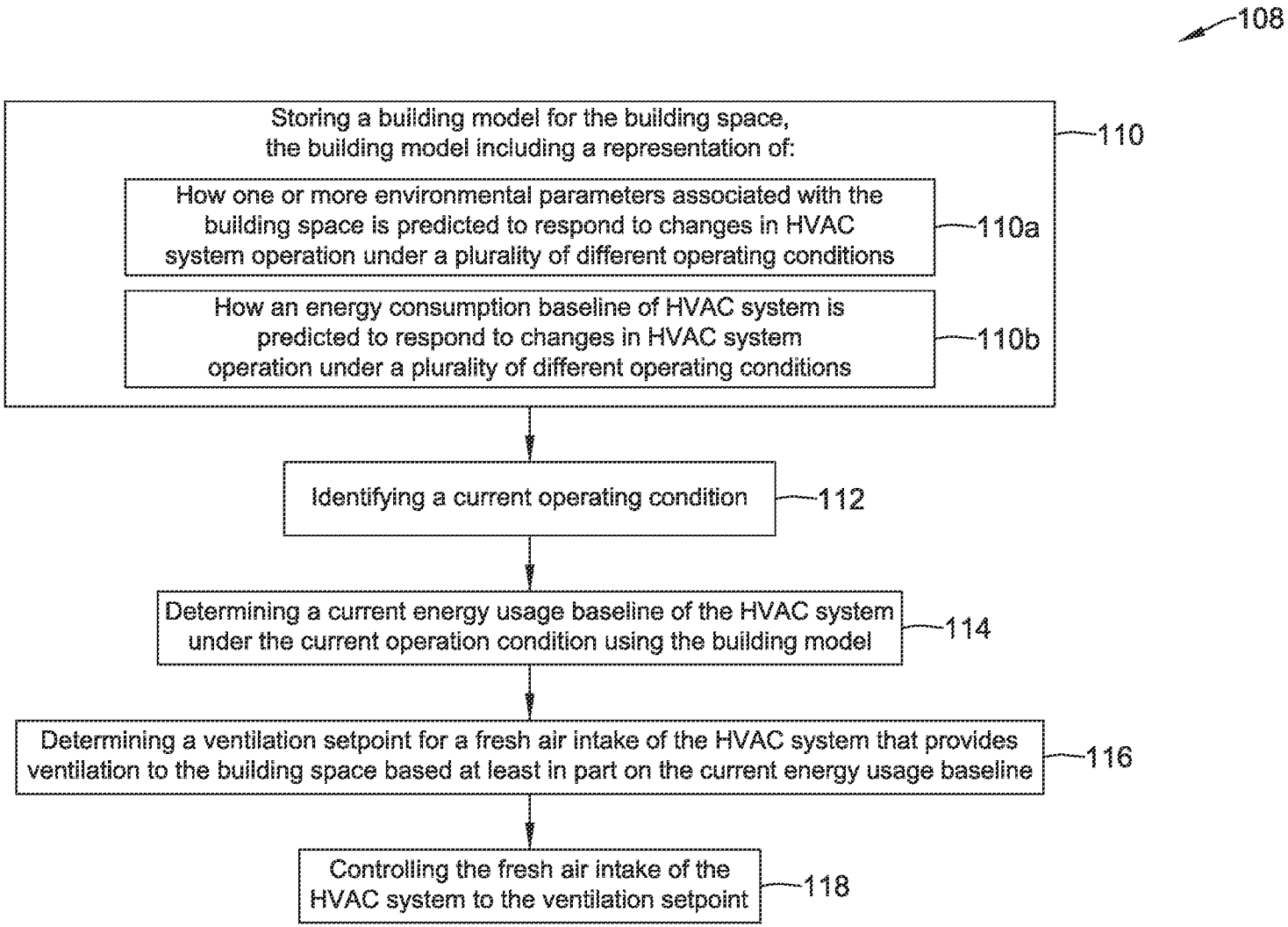
FIG. 7 is a flow diagram showing an illustrative method for operating the illustrative HVAC control system of FIG. 1.

FIG. 7 is a flow diagram showing an illustrative method 108 for operating the HVAC control system 10. The illustrative method 108 includes storing a building model for the building space, as indicated at block 110. The building model includes a representation of how one or more environmental parameters associated with the building space is predicted to respond to changes in HVAC system operation under a plurality of different operating conditions, as indicated at block 110*a*. The building model includes a representation of how an energy consumption baseline of the HVAC system is predicted to respond to changes in HVAC system operation under a plurality of different operating conditions, as indicated at block 110*b*.

The method 108 includes identifying a current operating condition, as indicated at block 112. A current energy usage baseline of the HVAC system under the current operation condition is determined using the building model, as indicated at block 114. A ventilation setpoint for a fresh air intake of the HVAC system that provides ventilation to the building space is determined based at least in part on the current energy usage baseline, as indicated at block 116. The fresh air intake of the HVAC system is controlled to the ventilation setpoint, as indicated at block 118. In some cases, determining the ventilation setpoint for the fresh air intake of the HVAC system may also be based at least in part on a concentration of one or more IAQ contaminates in the building space.

Figure 8:
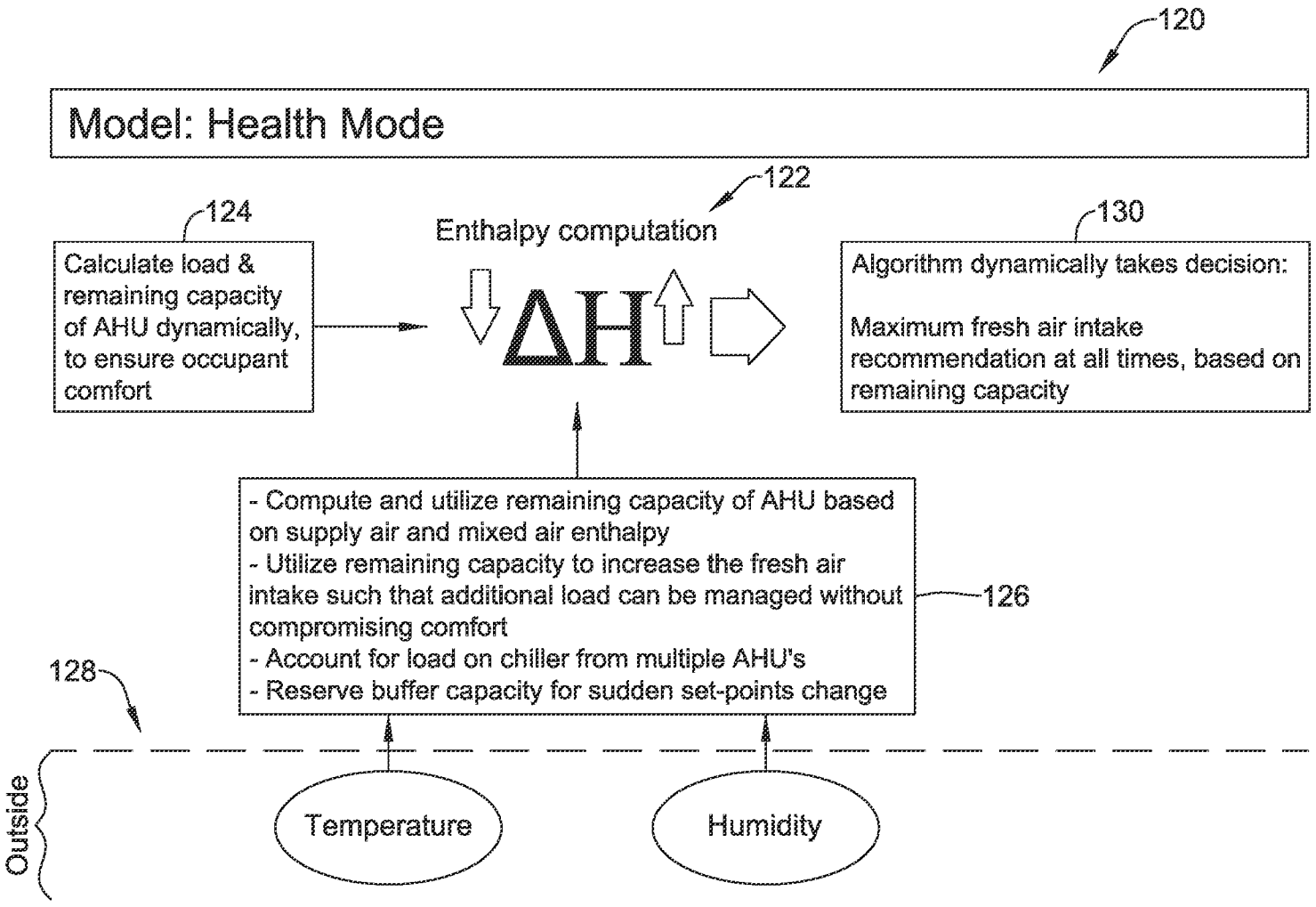
FIG. 8 is a schematic view of a health mode model.
Figure 9:
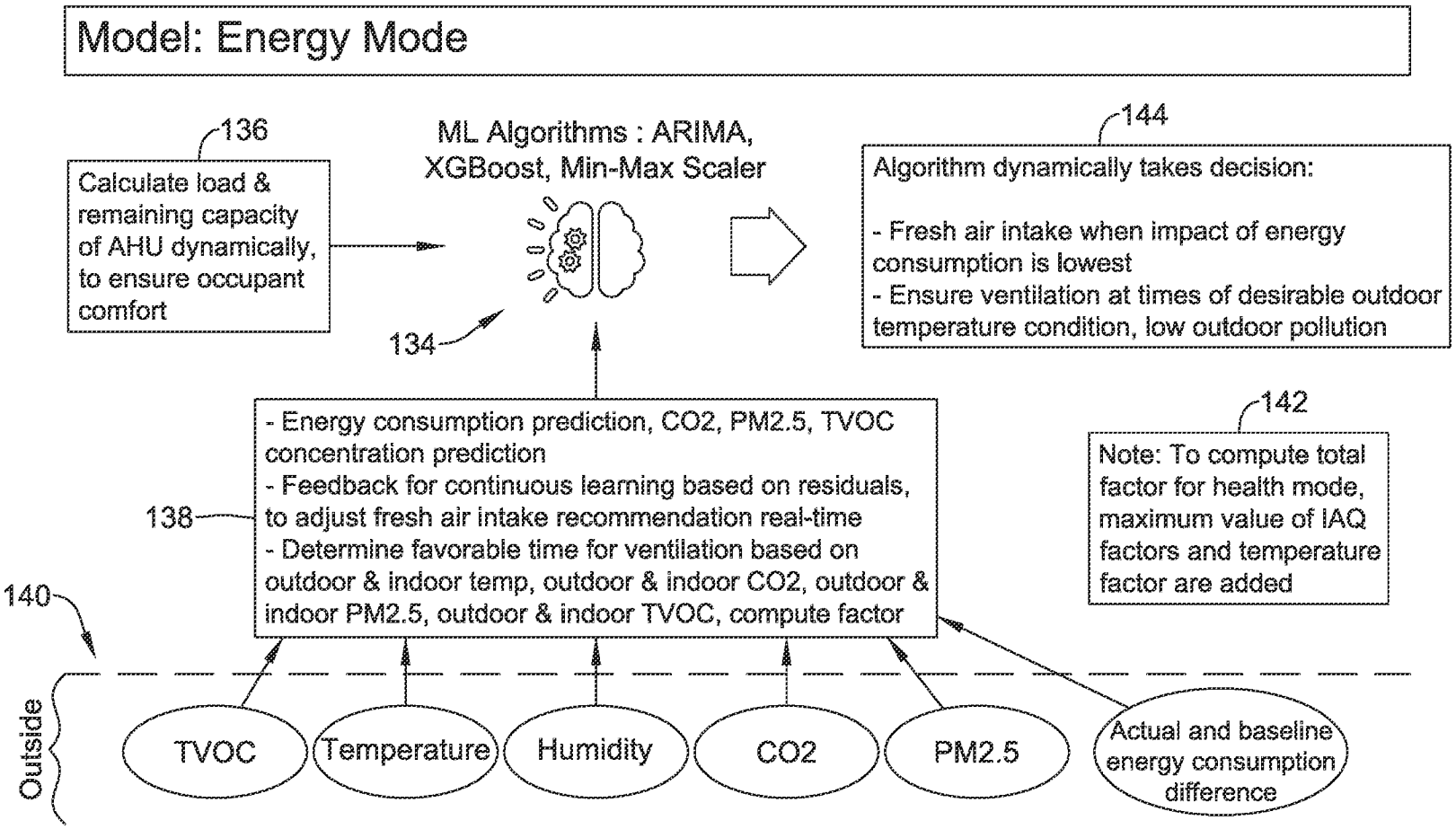
FIG. 9 is a schematic view of an energy mode model.
Figure 10:
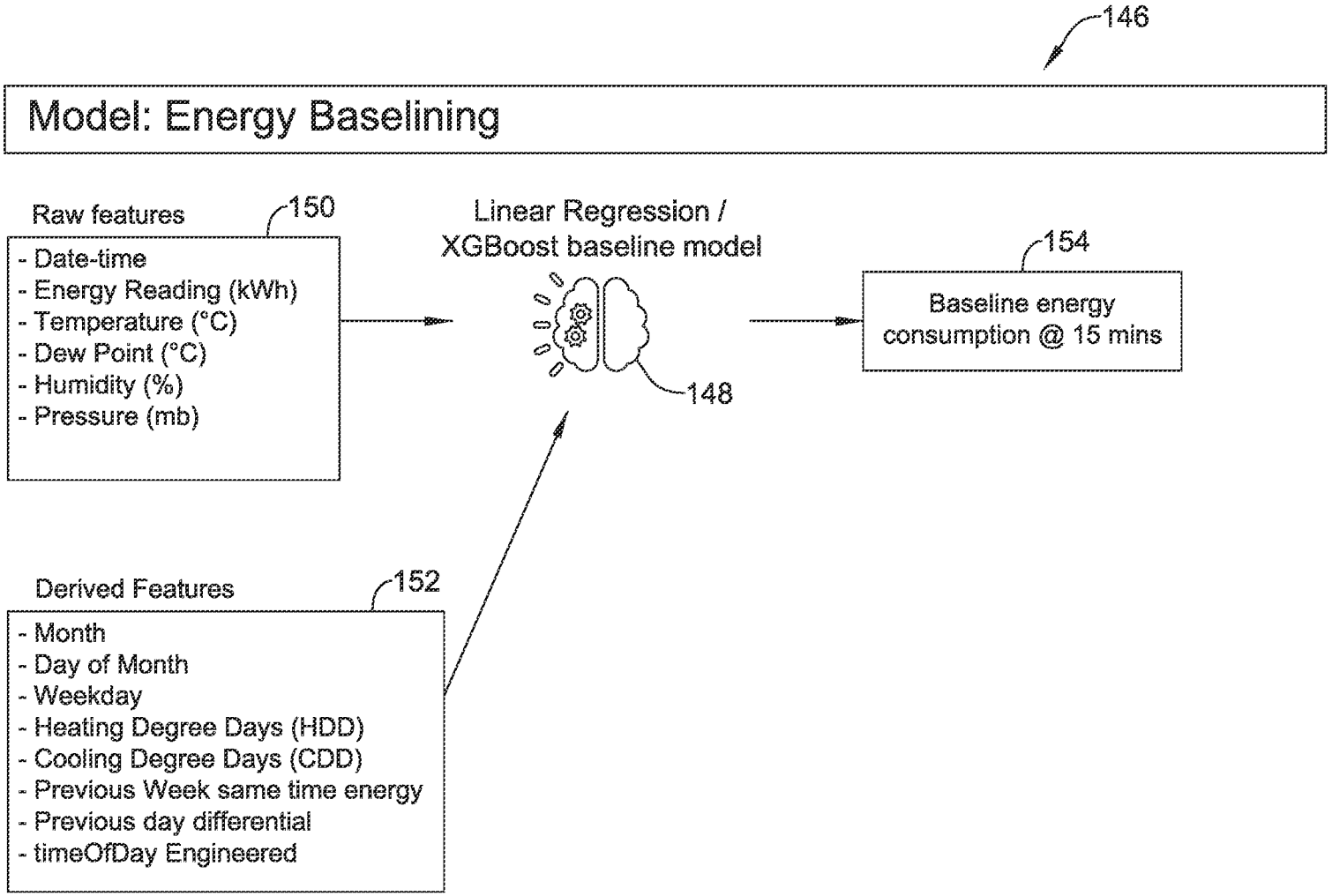
FIG. 10 is a schematic view of an energy baselining model.
Figure 11:
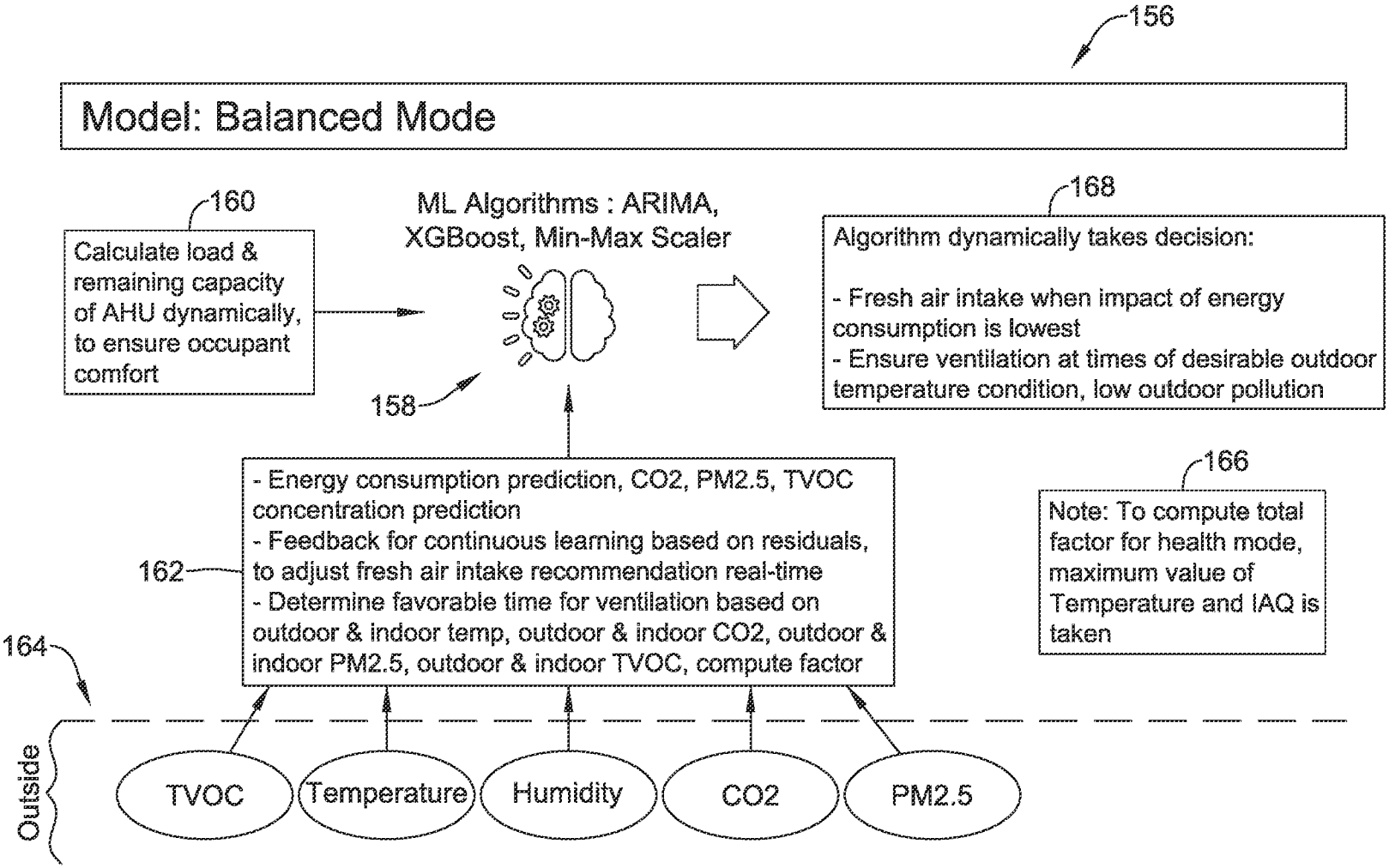
FIG. 11 is a schematic view of a balanced mode model.

The HVAC control system 10 may operate in accordance with a number of different modes, as shown for example in FIGS. 2 through 7. FIG. 8 provides details regarding the health mode, FIGS. 9 and 10 provide details regarding the energy modes, and FIG. 11 provides details regarding the balanced mode.

FIG. 8 shows a health mode model 120 that revolves around an enthalpy computation 122. In some cases, the enthalpy computation 122 can provide an indication of how close an AHU (air handling unit) is to capacity, for example. The enthalpy computation 122 can provide details regarding the current load and the remaining capacity, if any, of a particular AHU, as indicated at block 124. The enthalpy computation 122 also takes into account additional details, such as but not limited to the supply air enthalpy and the mixed air enthalpy, the load placed on a chiller by multiple AHUs and a reserve buffer capacity if there are any sudden setpoint changes, as indicated at block 126. In the example shown, outside data 128 includes air temperature values and air humidity values. An output from the enthalpy computation 122 includes a dynamically changing maximum fresh air intake recommendation that satisfies remaining capacity concerns, as indicated at block 130.

The following equations are of use in performing the enthalpy computation 122:

$$E_{rem} = E_{total} - E_{sp} - E_{addn}$$

$E_{rem}$=remaining capacity of AHU
$E_{total}$=total capacity of AHU
$E_{sp}$=capacity used to meet setpoint
$E_{addn}$=capacity used for additional outdoor air intake $$\text{mixed air temp} = \left(OA\ temp * \frac{OA\ \text{flow rate}}{OA\ \text{flow rate} + RA\ \text{flow rate}}\right) + \left(RA\ temp * \frac{RA\ \text{flow rate}}{OA\ \text{flow rate} + RA\ \text{flow rate}}\right)$$

$$\text{mixed air } RH = \left(OA\ rH * \frac{OA\ \text{flow rate}}{OA\ \text{flow rate} + RA\ \text{flow rate}}\right) + \left(RA\ rH * \frac{RA\ \text{flow rate}}{OA\ \text{flow rate} + RA\ \text{flow rate}}\right)$$

Atmospheric pressure (psi) may be calculated using temperature (T) and sea level elevation (h):

$$\text{atm} = 101325 * ((T + 273.15)/(T + 0.0065 * h + 27 \ldots 15)) * 5.257/6895 \text{ psi}$$

Enthalpy can be calculated using temp, rH and atm pressure and the Python library:

$$psychrolib.CalPsychometricsFromRelHum\left(temp, \frac{rH}{100}, \text{atm}\right)[4]BTU/\text{lb}$$

RESET™ air quality standard thresholds may be applied as indicated:

| | Health | Balanced | Energy | Energy 1 | Energy 2 | Energy 3 |
|---|---|---|---|---|---|---|
| PM2.5 (μg/m³) | <12 | <12 | <18 | <24 | <30 | <35 |
| TVOC (μg/m³) | <400 | <400 | <425 | <450 | <475 | <500 |
| CO2 (ppm) | <600 | <600 | <700 | <800 | <900 | <1000 |

FIG. 9 shows an energy mode model 132 that revolves around several ML (Machine Learning) algorithms 134. The ML algorithms 134 may be considered as dynamically calculating load and remaining capacity, as indicated at block 136. The ML algorithms 134 may perform a number of predictions, such as but not limited to energy consumption predictions and IAQ (indoor air quality) predictions, determining favorable times for ventilation given a variety of factors, as indicated at block 138. Outside data 140 includes TVOC values, temperature, humidity, $CO_2$, PM2.5 and a comparison between actual and baseline energy consumption. The ML algorithms 134 also take into account maximum values of IAQ factors and temperature factors, as indicated at block 142. The ML algorithms 134 dynamically determine the optimal times for ventilation, such as when impact on energy consumption is lowest and outside air quality is optimal, as indicated at block 144.

FIG. 10 shows an energy baselining model 146. The energy baselining model 146 includes a linear regression model 148. The linear regression model 148 receives a number of raw features, as indicated at block 150. Raw features are data points directly obtainable from one or more sensors, for example. The linear regression model 148 also receives a number of derived features, as indicated at block 152. Derived features are data points that are calculated from one or more different sensor values. The linear regression model 148 outputs a baseline energy consumption value every 15 minutes, as indicated at block 154. Further details regarding energy baselining may be found in U.S. Ser. No. 17/827,230 entitled AUTOMATIC MACHINE LEARNING BASED PREDICTION OF BASELINE ENERGY CONSUMPTION, filed May 27, 2022, which application is incorporated by reference herein in its entirety.

The following equation describes a relationship between health and energy modes:

$$\text{energy} = \delta_{energy} * \text{health}$$

$\delta_{energy}$ is total factor for energy mode, and health and energy are OA flow setpoint recommendations for health and energy modes.

Total factor:

$$\delta_{energy} = 0.5 * \max(iaq_{CO_2}, iaq_{pm2.5}, iaq_{tvoc}) + 0.5 * \text{temp}$$

temp=temperature factor
$iaq_{CO_2}$=$CO_2$ factor
$iaq_{pm2.5}$=PM2.5 factor
$iaq_{tvoc}$=TVOC factor
The following equations describe the temperature factor:

$$temp = \frac{\text{factor}_1 + \text{factor}_2}{2} \text{ if } temp_{outdoor\ air} < temp_{returnairl}, \text{then factor}_1 = 1 \text{ else factor}_1 = \text{scale}_{0-1} \frac{temp_{returnair}}{temp_{outdoorair}}$$

$$temp_{max} = \max(prevday) temp_{outdoorair}$$

$$\text{if } temp_{outdoorair} > temp_{\max} \text{ then factor}_2 = 0$$

$$\text{else factor}_2 = \text{scale}_{0-1}(1 - \frac{temp_{outdoorair}}{temp_{max}}$$

The following equations describe the IAQ factors:

$$iaq_{CO_2} = \sqrt{\alpha_{CO_2}\beta_{CO_2}}$$

$$iaq_{pm2.5} = \sqrt{\alpha_{pm2.5}\beta_{pm2.5}}$$

$$iaq_{tvoc} = \sqrt{\alpha_{tvoc}\beta_{tvoc}}$$

where α (for each of CO2, PM2.5, tvoc)=urgency factor, and
where β (for each of $CO_2$, PM2.5, tvoc)=favorability factor
The following equations describe computing the upper and lower RESET thresholds:

$$thresh_{lower} = thresh - 25\%\ thresh$$

$$thresh = \text{RESET threshold}$$

Compute Urgency Factor:

$$\alpha_{co_2} = \begin{cases} 0.2, \text{indoor}_{co_2} \le thresh_{lower} \\ 0.2e^d; d = \frac{(\text{indoor}_{co_2} - thresh_{lower})}{thresh_{lower}}, \\ thresh_{lower} \le \text{indoor}_{co_2} \text{ and indoor}_{co_2} \le thresh \\ 0.2e^d; d = \frac{(thresh - thresh_{lower})}{thresh_{lower}}, \text{indoor}_{co2} > thresh \end{cases}$$

Compute Favorability Factor:

$$\max_{CO_2} = \max_{PrevDay} \text{indoor}_{co_2}$$

$$\beta_{co_2} = \begin{cases} 0.3, \max_{CO_2} \le \text{indoor}_{co_2} \\ 0.3 \frac{\text{indoor}_{co_2}}{\max_{CO_2}}, \max_{CO_2} > \text{indoor}_{co_2} \end{cases}$$

FIG. 11 shows a balanced mode model 156 that revolves around several ML (Machine Learning) algorithms 158. The ML algorithms 158 may be considered as dynamically calculating load and remaining capacity, as indicated at block 160. The ML algorithms 158 may perform a number of predictions, such as but not limited to energy consumption predictions and IAQ (indoor air quality) predictions, determining favorable times for ventilation given a variety of factors, as indicated at block 162. Outside data 164 includes TVOC values, temperature, humidity, $CO_2$, and PM2.5. The ML algorithms 158 also take into account maximum values of IAQ factors and temperature factors, as indicated at block 166. The ML algorithms 158 dynamically determine the optimal times for ventilation, such as when impact on energy consumption is lowest and outside air quality is optimal, as indicated at block 168.

The following equation describes a relationship between health, energy and balanced modes:

$$\text{balanced} = \delta_{balanced} * \text{health}$$

$\delta_{balanced}$ is total factor for balanced mode, and balance and health are OA flow setpoint recommendations for balanced and health modes.

Total factor:

$$\delta_{balanced} = \max(iaq_{CO_2}, iaq_{pm2.5}, iaq_{tvoc})$$

temp=temperature factor
$iaq_{CO_2}$=$CO_2$ factor
$iaq_{pm2.5}$=PM2.5 factor
$iaq_{tvoc}$=TVOC factor
The following equations describe the temperature factor:

$$temp = \frac{\text{factor}_1 + \text{factor}_2}{2} \text{ if } temp_{outdoor\ air} < temp_{returnairl}, \text{then factor}_1 = 1 \text{ else factor}_1 = \text{scale}_{0-1} \frac{temp_{returnair}}{temp_{outdoorair}}$$

$$temp_{max} = \max(prevday) temp_{outdoorair}$$

$$\text{if } temp_{outdoorair} > temp_{max} \text{ then factor}_2 = 0$$

$$\text{else factor}_2 = \text{scale}_{0-1}(1 - \frac{temp_{outdoorair}}{temp_{max}}$$

The following equations describe computing the upper and lower RESET thresholds:

$$thresh_{lower} = thresh - 25\%\ thresh$$

$$thresh = \text{RESET threshold}$$

Compute urgency factor:

$$\alpha_{co_2} = \begin{cases} 0.2, \text{indoor}_{co_2} \le thresh_{lower} \\ 0.2e^d; d = \frac{(\text{indoor}_{co_2} - thresh_{lower})}{thresh_{lower}}, \\ thresh_{lower} \le \text{indoor}_{co_2} \text{ and indoor}_{co_2} \le thresh \\ 0.2e^d; d = \frac{(thresh - thresh_{lower})}{thresh_{lower}}, \text{indoor}_{co2} > thresh \end{cases}$$

Compute favorability factor:

$$\max_{CO_2} = \max_{PrevDay} \text{indoor}_{co_2}$$

$$\beta_{co_2} = \begin{cases} 0.3, \max_{CO_2} \leq \text{indoor}_{co_2} \\ 0.3 \dfrac{\text{indoor}_{co_2}}{\max_{CO_2}}, \max_{CO_2} > \text{indoor}_{co_2} \end{cases}$$

Figure 12:
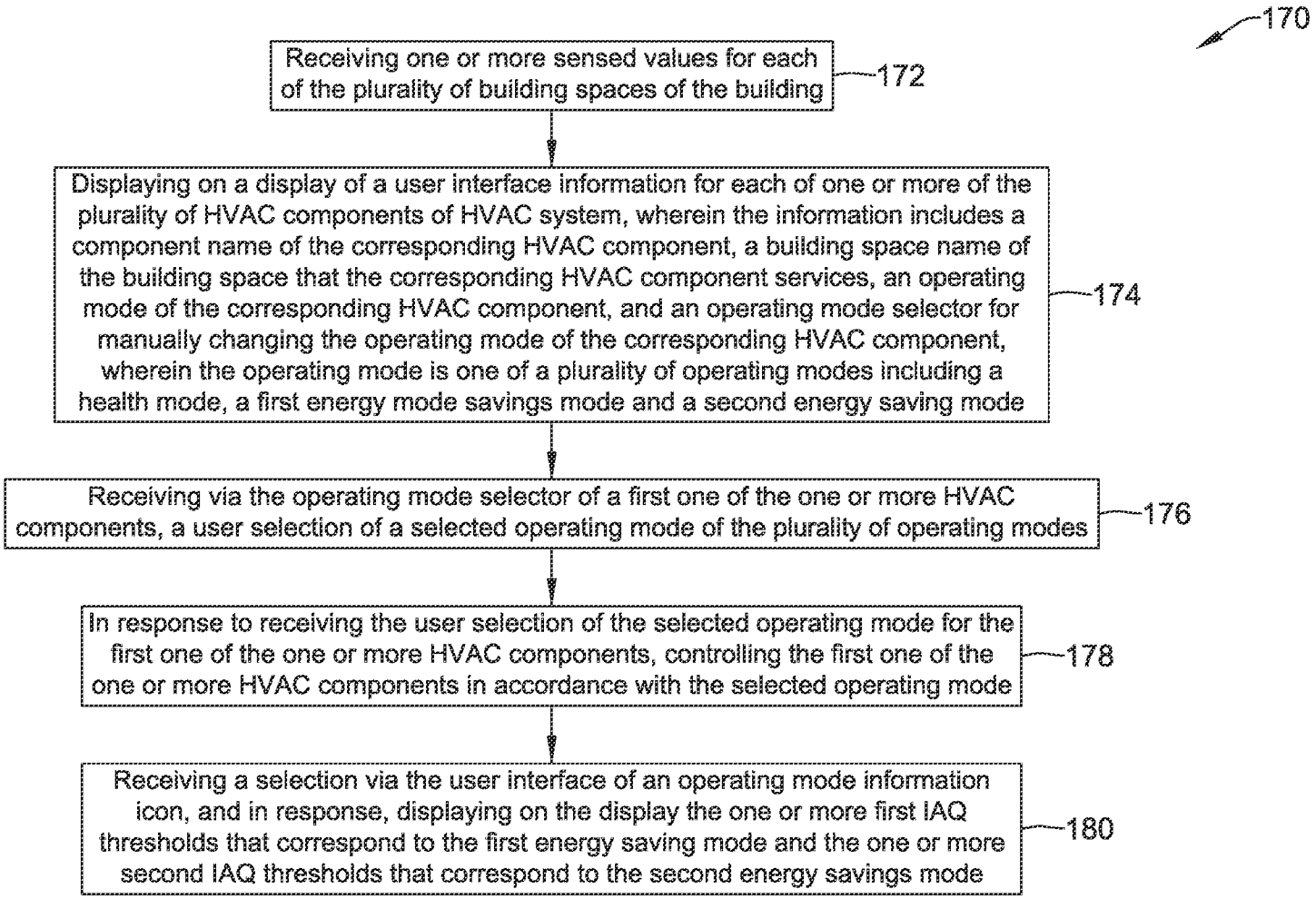
FIG. 12 is a flow diagram showing an illustrative method for operating the illustrative HVAC control system of FIG. 1.

FIGS. 12 through 15 provide flow diagrams that pertain to how the HVAC control system 10 may displays data. FIG. 12 is a flow diagram showing an illustrative method 170 for operating a Heating, Ventilating and/or Air Conditioning (HVAC) system that services a building, the HVAC system including a plurality of HVAC components each servicing a corresponding one of a plurality of building spaces of the building. The illustrative method 170 includes receiving one or more sensed values for each of the plurality of building spaces of the building, as indicated at block 172. Information for each of one or more of the plurality of HVAC components of the HVAC system is displayed on a display of a user interface, wherein the information includes a component name of the corresponding HVAC component, a building space name of the building space that the corresponding HVAC component services, an operating mode of the corresponding HVAC component, and an operating mode selector for manually changing the operating mode of the corresponding HVAC component, wherein the operating mode is one of a plurality of operating modes that include a health mode, a first energy savings mode and a second energy savings mode, as indicated at block 174.

In some cases, the information that is displayed for each of one or more of the plurality of HVAC components of the HVAC system may include one or more sensed values for the building space that the corresponding HVAC component services. The one or more sensed values may include one or more of a sensed temperature value and a sensed humidity value. The one or more sensed values may include one or more of a sensed $CO_2$ value, a sensed PM2.5 value and a sensed TVOC value, for example.

In some cases, the health mode, when selected, attempts to maximize ventilation to the building space subject to one or more constraints including a constraint of maintaining one or more comfort conditions in the building space. The first energy savings mode, when selected, attempts to minimize energy consumed by the HVAC system to condition air supplied to the building space subject to one or more constraints including a constraint of maintaining one or more comfort conditions in the building space and a constraint to maintain IAQ contaminants in the building space below one or more first IAQ thresholds. The second energy savings mode, when selected, attempts to minimize energy consumed by the HVAC system to condition air supplied to the building space subject to one or more constraints including a constraint of maintaining one or more comfort conditions in the building space and a constraint to maintain IAQ contaminants in the building space below one or more second IAQ thresholds, wherein the one or more second IAQ thresholds are less stringent than the one or more first IAQ thresholds.

In some cases, the plurality of operating modes may include a third energy savings mode that attempts to minimize energy consumed by the HVAC system to condition air supplied to the building space subject to one or more constraints including a constraint of maintaining one or more comfort conditions in the building space and a constraint to maintain IAQ contaminants in the building space below one or more third IAQ thresholds, wherein the one or more third IAQ thresholds are less stringent than the one or more second IAQ thresholds, for example. In some cases, the plurality of operating modes may further include a fourth energy savings mode that attempts to minimize energy consumed by the HVAC system to condition air supplied to the building space subject to one or more constraints including a constraint of maintaining one or more comfort conditions in the building space and a constraint to maintain IAQ contaminants in the building space below one or more fourth IAQ thresholds, wherein the one or more fourth IAQ thresholds are less stringent than the one or more third IAQ thresholds.

In some cases, the plurality of operating modes may include a balanced mode that when selected attempts to control ventilation to the building space to maintain IAQ contaminants in the building space below one or more balance mode IAQ thresholds subject to one or more constraints including a constraint of maintaining one or more comfort conditions in the building space.

The illustrative method 170 includes receiving, via the operating mode selector of a first one of the one or more HVAC components, a user selection of a selected operating mode of the plurality of operating mode, as indicated at block 176. In response to receiving the user selection of the selected operating mode for the first one of the one or more HVAC components, the first one of the one or more HVAC components is controlled in accordance with the selected operating mode, as indicated at block 178. In some cases, the method 170 may further include receiving a selection via the user interface of an operating mode information icon, and in response, displaying on the display the one or more first IAQ thresholds that correspond to the first energy saving mode and the one or more second IAQ thresholds that correspond to the second energy savings mode, as indicated at block 180.

Figure 13A:
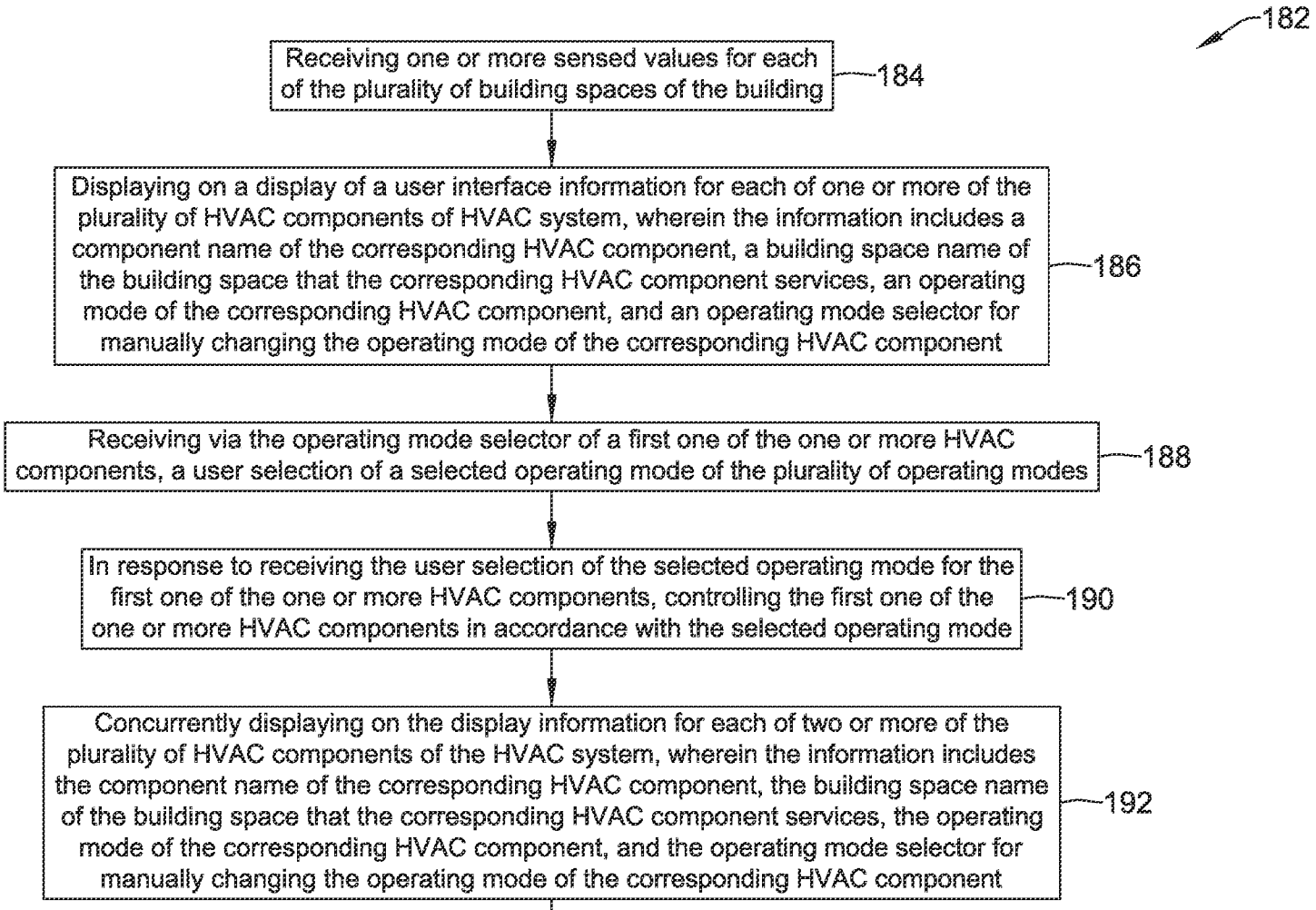
FIGS. 13A and 13B are flow diagrams that together show an illustrative method for operating the illustrative HVAC control system of FIG. 1.
Figure 13B:
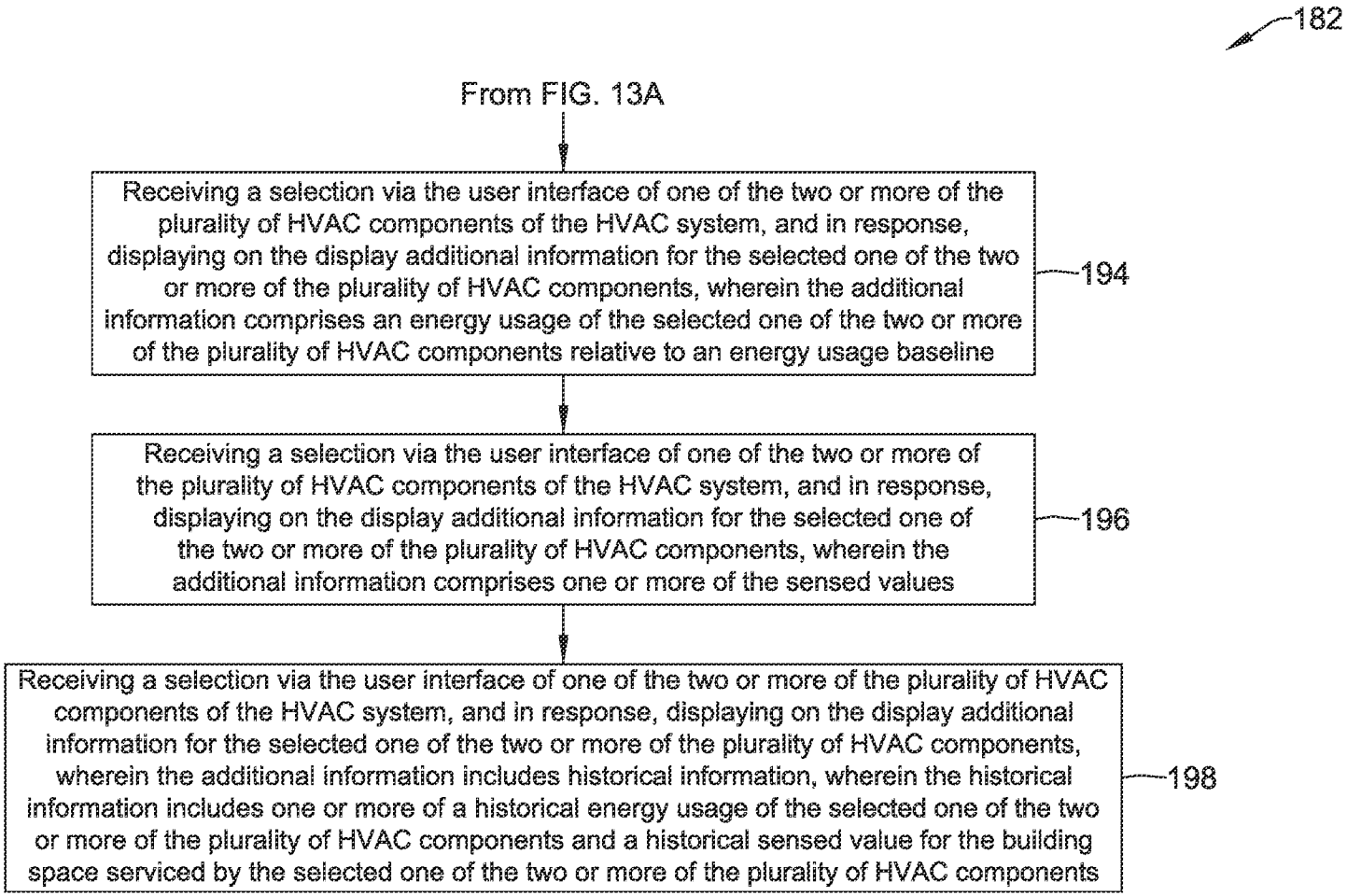

FIGS. 13A and 13B are flow diagrams that together show an illustrative method 182 for operating a Heating, Ventilating and/or Air Conditioning (HVAC) system that services a building. The HVAC system includes a plurality of HVAC components each servicing a corresponding one of a plurality of building spaces of the building. The illustrative method 182 includes receiving one or more sensed values for each of the plurality of building spaces of the building, as indicated at block 184. Information for each of one or more of the plurality of HVAC components of the HVAC system is displayed on a display of a user interface, wherein the information includes a component name of the corresponding HVAC component, a building space name of the building space that the corresponding HVAC component services, an operating mode of the corresponding HVAC component, and an operating mode selector for manually changing the operating mode of the corresponding HVAC component, as indicated at block 186.

In some cases, the information that is displayed for each of one or more of the plurality of HVAC components of the HVAC system may include one or more sensed values for the building space that the corresponding HVAC component services. The one or more sensed values may include one or may include of a sensed temperature value and a sensed humidity value. The one or more sensed values may include one or more of a sensed $CO_2$ value, a sensed PM2.5 value and a sensed TVOC value, for example.

The method 182 includes receiving, via the operating mode selector of a first one of the one or more HVAC components, a user selection of a selected operating mode of the plurality of operating mode, as indicated at block 188. In response to receiving the user selection of the selected operating mode for the first one of the one or more HVAC components, the first one of the one or more HVAC components is controlled in accordance with the selected operating mode, as indicated at block 190. In some cases, the method 190 may further include concurrently displaying on the display information for each of two or more of the plurality of HVAC components of the HVAC system, wherein the information includes the component name of the corresponding HVAC component, the building space name of the building space that the corresponding HVAC component services, the operating mode of the corresponding HVAC component, and the operating mode selector for manually changing the operating mode of the corresponding HVAC component, as indicated at block 192.

The method 182 continues on FIG. 13B, with receiving a selection via the user interface of one of the two or more of the plurality of HVAC components of the HVAC system, and in response, displaying on the display additional information for the selected one of the two or more of the plurality of HVAC components, wherein the additional information includes an energy usage of the selected one of the two or more of the plurality of HVAC components relative to an energy usage baseline, as indicated at block 194. In some cases, the method 182 may include receiving a selection via the user interface of one of the two or more of the plurality of HVAC components of the HVAC system, and in response, displaying on the display additional information for the selected one of the two or more of the plurality of HVAC components, wherein the additional information includes one or more of the sensed values, as indicated at block 196.

In some cases, the method 182 may further include receiving a selection via the user interface of one of the two or more of the plurality of HVAC components of the HVAC system, and in response, displaying on the display additional information for the selected one of the two or more of the plurality of HVAC components, wherein the additional information includes historical information, wherein the historical information includes one or more of a historical energy usage of the selected one of the two or more of the plurality of HVAC components and a historical sensed value for the building space serviced by the selected one of the two or more of the plurality of HVAC components, as indicated at block 198. As an example, the historical sensed value may include one or more of a historical sensed temperature value, a historical sensed humidity value, a historical sensed CO2 value, a historical sensed PM2.5 value and a historical sensed TVOC value for the building space serviced by the selected one of the two or more of the plurality of HVAC components. In some cases, the historical information may include a historical operating mode of the selected one of the two or more of the plurality of HVAC components.

Figure 14A:
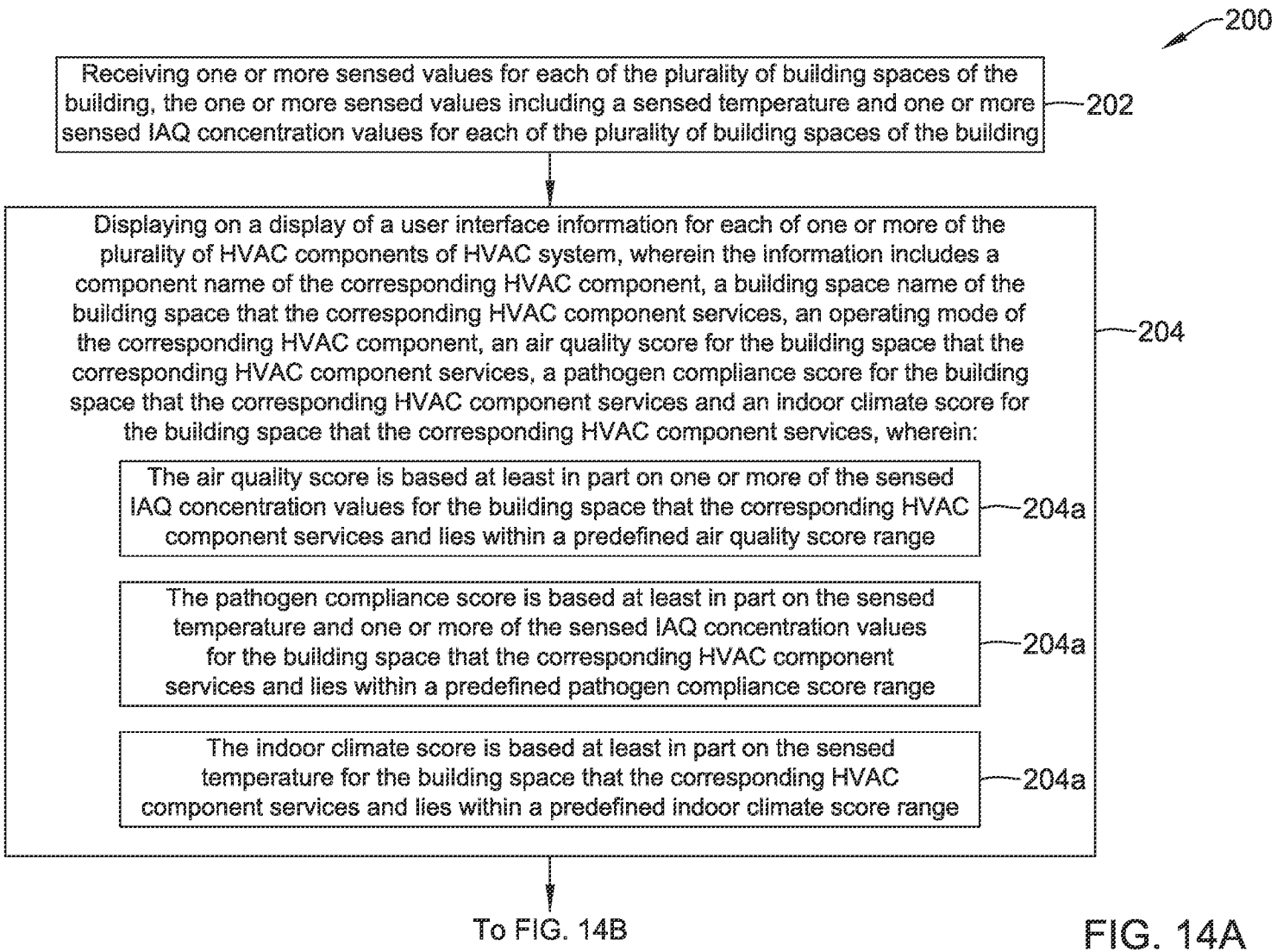
FIGS. 14A and 14B are flow diagrams that together show an illustrative method for operating the illustrative HVAC control system of FIG. 1.
Figure 14B:
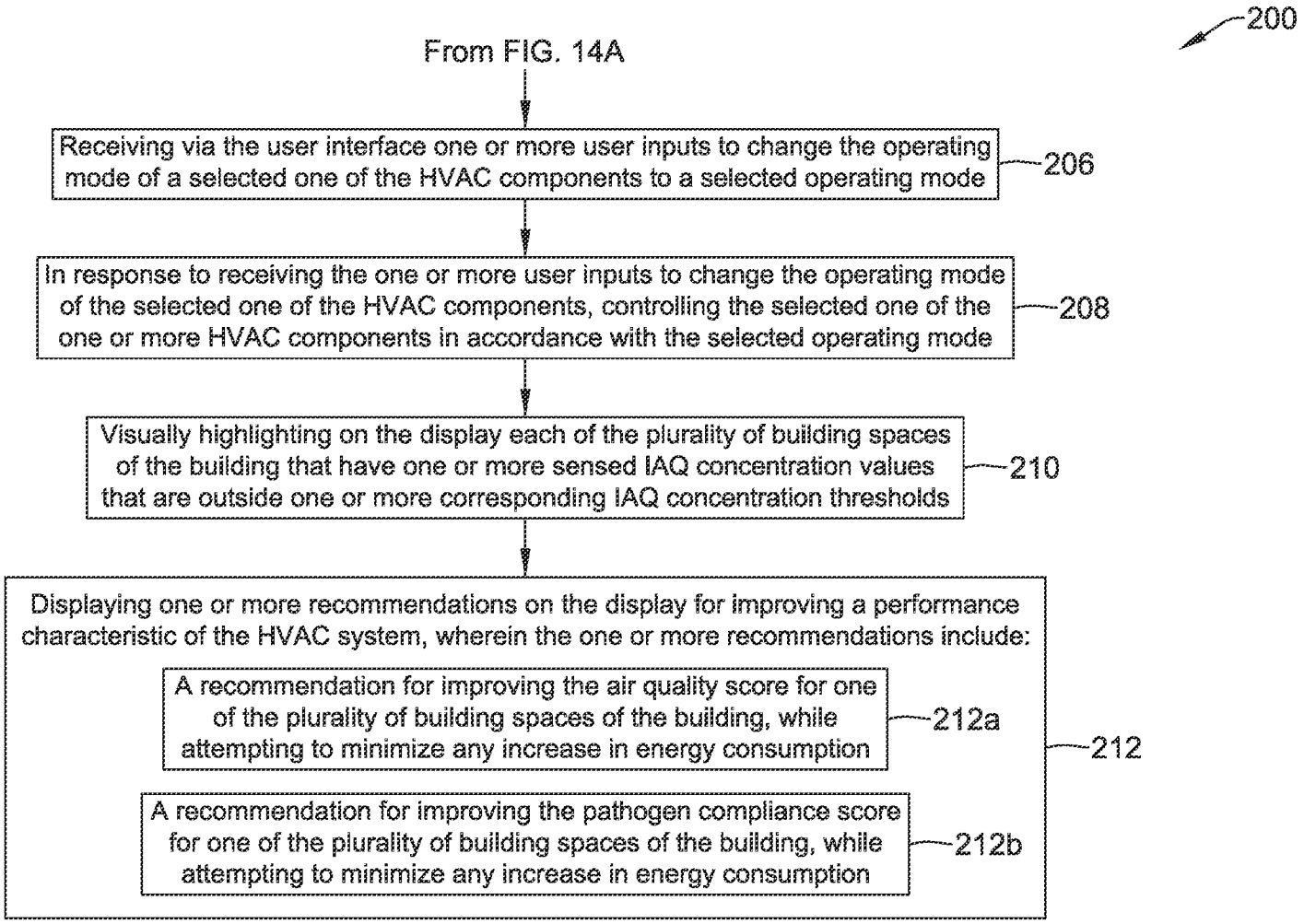

FIGS. 14A and 14B are flow diagrams that together show an illustrative method 200 for operating a Heating, Ventilating and/or Air Conditioning (HVAC) system that services a building. The HVAC system includes a plurality of HVAC components each servicing a corresponding one of a plurality of building spaces of the building. The illustrative method 200 includes receiving one or more sensed values for each of the plurality of building spaces of the building, the one or more sensed values including a sensed temperature and one or more sensed IAQ concentration values for each of the plurality of building spaces of the building, as indicated at block 202.

Information for each of one or more of the plurality of HVAC components of the HVAC system is displayed on a display of a user interface, wherein the information includes a component name of the corresponding HVAC component, a building space name of the building space that the corresponding HVAC component services, an operating mode of the corresponding HVAC component, an air quality score for the building space that the corresponding HVAC component services, a pathogen compliance score for the building space that the corresponding HVAC component services and an indoor climate score for the building space that the corresponding HVAC component services, as indicated at block 204. In some instances, the information may further include one or more of an occupant count parameter for the building space that the corresponding HVAC component services and an air changes per hour parameter for the building space that the corresponding HVAC component services.

In some cases, the air quality score is based at least in part on one or more of the sensed IAQ concentration values for the building space that the corresponding HVAC component services and lies within a predefined air quality score range, as indicated at block 204*a*. The pathogen compliance score is based at least in part on the sensed temperature and one or more of the sensed IAQ concentration values for the building space that the corresponding HVAC component services and lies within a predefined pathogen compliance score range, as indicated at block 204*b*. The indoor climate score is based at least in part on the sensed temperature for the building space that the corresponding HVAC component services and lies within a predefined indoor climate score range, as indicated at block 204*c*.

The method 200 continues on FIG. 14B, with receiving via the user interface one or more user inputs to change the operating mode of a selected one of the HVAC components to a selected operating mode, as indicated at block 206. In response to receiving the one or more user inputs to change the operating mode of the selected one of the HVAC components, controlling the selected one of the one or more HVAC components in accordance with the selected operating mode, as indicated at block 208. In some cases, the operating mode is one of a plurality of operating modes that include a health mode that when selected attempts to maximize ventilation to the building space subject to one or more constraints including a constraint of maintaining one or more comfort conditions in the building space, a first energy savings mode that attempts to minimize energy consumed by the HVAC system to condition air supplied to the building space subject to one or more constraints including a constraint of maintaining one or more comfort conditions in the building space and a constraint to maintain IAQ contaminants in the building space below one or more first IAQ thresholds, and a second energy savings mode that attempts to minimize energy consumed by the HVAC system to condition air supplied to the building space subject to one or more constraints including a constraint of maintaining one or more comfort conditions in the building space and a constraint to maintain IAQ contaminants in the building space below one or more second IAQ thresholds, wherein the one or more second IAQ thresholds are less stringent than the one or more first IAQ thresholds.

In some cases, the method 200 may further include visually highlighting on the display each of the plurality of building spaces of the building that have one or more sensed IAQ concentration values that are outside one or more corresponding IAQ concentration thresholds, as indicated at block 210. In some instances, the method 200 may further include displaying one or more recommendations on the display for improving a performance characteristic of the HVAC system, as indicated at block 212. The one or more recommendations may include a recommendation for improving the air quality score for one of the plurality of building spaces of the building, while attempting to minimize any increase in energy consumption, as indicated at block 212*a*. The one or more recommendations may include a recommendation for improving the pathogen compliance score for one of the plurality of building spaces of the building, while attempting to minimize any increase in energy consumption, as indicated at block 212*b*.

Figure 15:
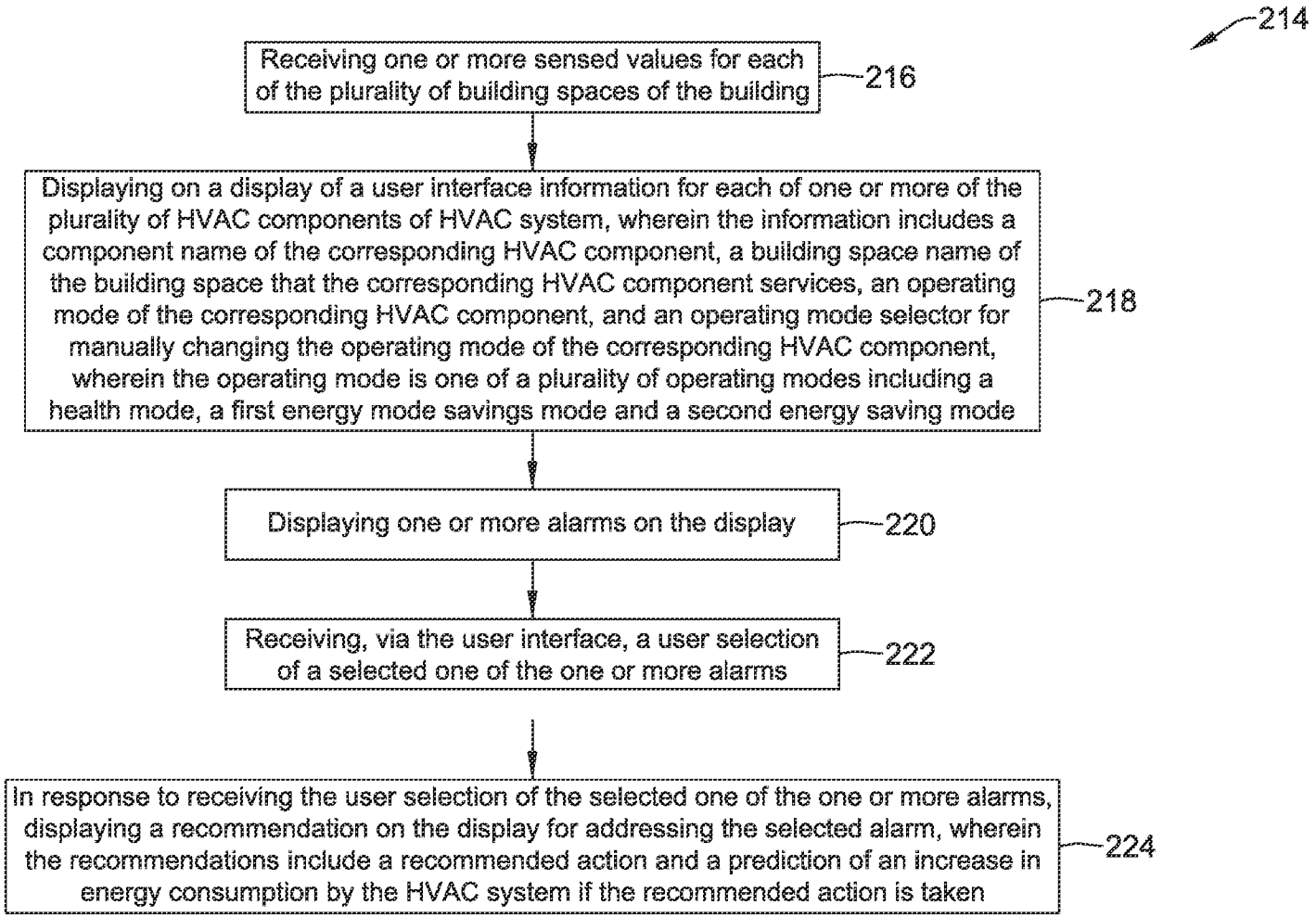
FIG. 15 is a flow diagram showing an illustrative method for operating the illustrative HVAC control system of FIG. 1.

FIG. 15 is a flow diagram showing an illustrative method 214 for operating a Heating, Ventilating and/or Air Conditioning (HVAC) system that services a building. The HVAC system includes a plurality of HVAC components each servicing a corresponding one of a plurality of building spaces of the building. The illustrative method 214 includes receiving one or more sensed values for each of the plurality of building spaces of the building, as indicated at block 216. Information for each of one or more of the plurality of HVAC components of the HVAC system is displayed on a display of a user interface, wherein the information includes a component name of the corresponding HVAC component, a building space name of the building space that the corresponding HVAC component services, an operating mode of the corresponding HVAC component, and an operating mode selector for manually changing the operating mode of the corresponding HVAC component, wherein the operating mode is one of a plurality of operating modes that include a first energy savings mode and a second energy savings mode, as indicated at block 218.

In some cases, the first energy savings mode attempts to minimize energy consumed by the HVAC system to condition air supplied to the building space subject to one or more constraints including a constraint of maintaining one or more comfort conditions in the building space and a constraint to maintain IAQ contaminants in the building space below one or more first IAQ thresholds. The second energy savings mode may attempt to minimize energy consumed by the HVAC system to condition air supplied to the building space subject to one or more constraints including a constraint of maintaining one or more comfort conditions in the building space and a constraint to maintain IAQ contaminants in the building space below one or more second IAQ thresholds, wherein the one or more second IAQ thresholds are less stringent than the one or more first IAQ thresholds. The method may include displaying one or more alarms on the display, as indicated at block 220. A user selection of a selected one of the one or more alarms is received via the user interface, as indicated at block 222. In response to receiving the user selection of the selected one of the one or more alarms, a recommendation on the display for addressing the selected alarm is displayed, wherein the recommendations include a recommended action and a prediction of an increase in energy consumption by the HVAC system if the recommended action is taken, as indicated at block 224.

Figure 16:
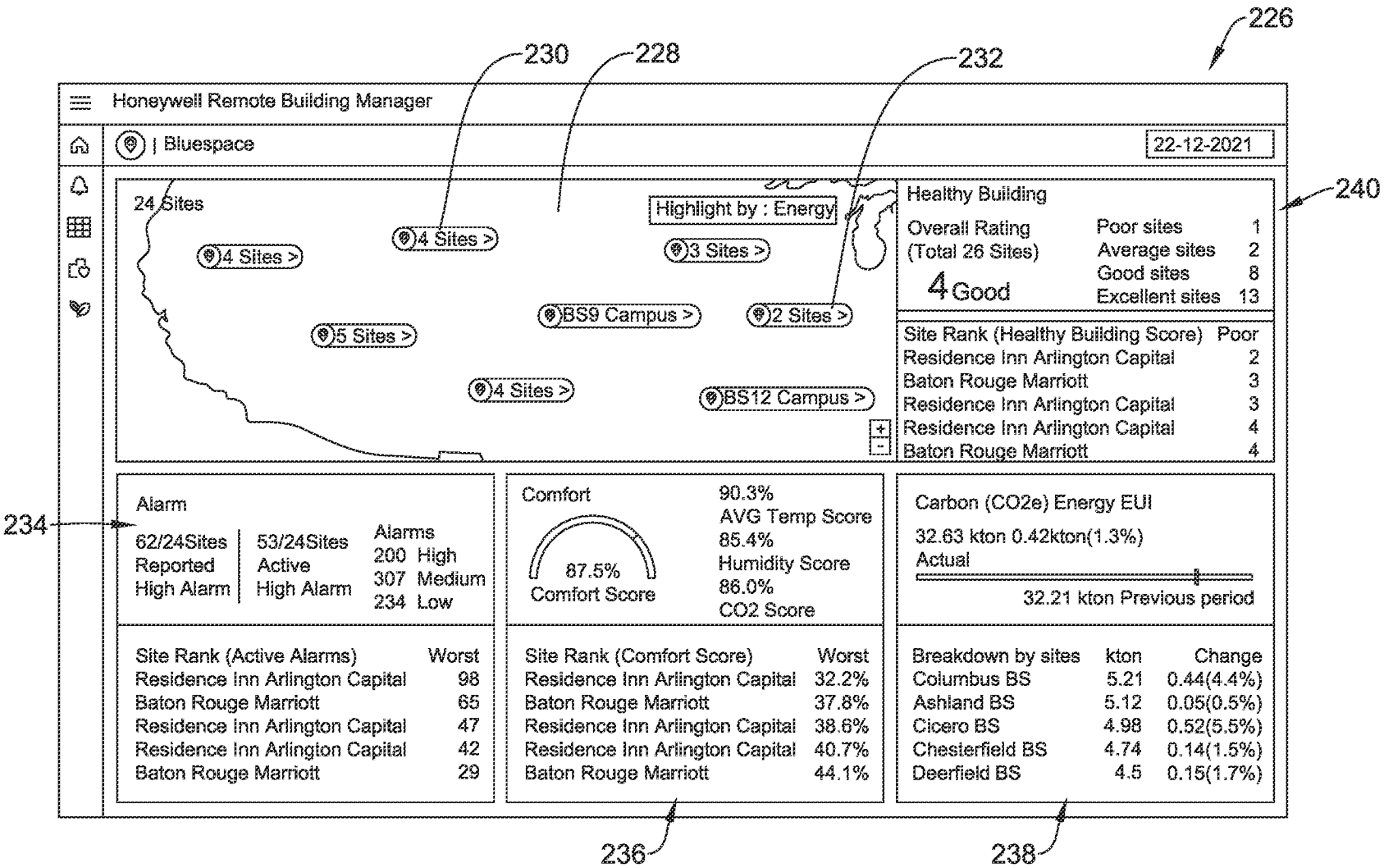
FIGS. 16 through 22 are screen shots showing examples of dashboards that may be displayed in combination with operating the illustrative HVAC control system of FIG. 1.

FIGS. 16 through 22 are screen captures showing illustrative screens that may be displayed as part of a dashboard generated and displayed by the HVAC control system 10. FIG. 16 shows a screen 226 that may be generated and displayed by the HVAC control system 10. The screen 226 provides a portfolio-wide view of the facilities that are part of an entity' s portfolio of facilities. The screen 226 provides a holistic view of healthy building parameters and ratings, comfort scores and carbon and energy overviews. The screen 226 includes a map 228 that shows a number of sites on the map 228. Most of the sites shown on the map 228 are performing well, while just a few sites are not performing as well. The map 228 includes an icon 230 and an icon 232 that are each colored red, or otherwise indicated as showing that the icons 230 and 232 represent sites or collections of sites that are not performing as well.

The screen 226 may be customized to include a variety of different sections, or cards. As shown, the screen 226 includes an alarms card 234 that includes a summary of how many active alarms there currently are across the portfolio, including a breakdown of how many high priority alarms, medium priority alarms and low priority alarms. The alarms card 234 also includes a listing of the sites (e.g. facilities) with active alarms. The screen 226 includes a comfort card 236 that shows at a glance an overall comfort score portfolio-wide, as well as a listing of comfort scores for each of a number of individual sites. As shown, the listed sites are ranked worst to first, but this is just an example. The screen 226 also includes a Carbon/Energy/Energy Usage Intensity (EUI) card 238 that provides a graphical representation of carbon, energy and EUI usage, and can be toggled between displaying carbon, energy and EUI usage. The screen 226 also includes a healthy building card 240 that may include an overall portfolio score, a listing of ranked sites, and a summary of the ranked sites.

A user viewing the screen 226 is able to see a substantial amount of information simultaneously, but is also able to drill down at each site, thereby getting additional information pertaining to equipment, devices and points summaries, along with healthy building scores/ratings and associated parameters, connectivity, alarms, comfort score and associated parameters, carbon overview and associated parameters, and energy overview and associated parameters. In some cases, a user is also able to change modes of operation for one or more HVAC components, such as AHUs, at a dashboard for a particular site, for example. The modes of operation can include a healthy mode, a balanced mode and one or several different energy modes.

Figure 17:
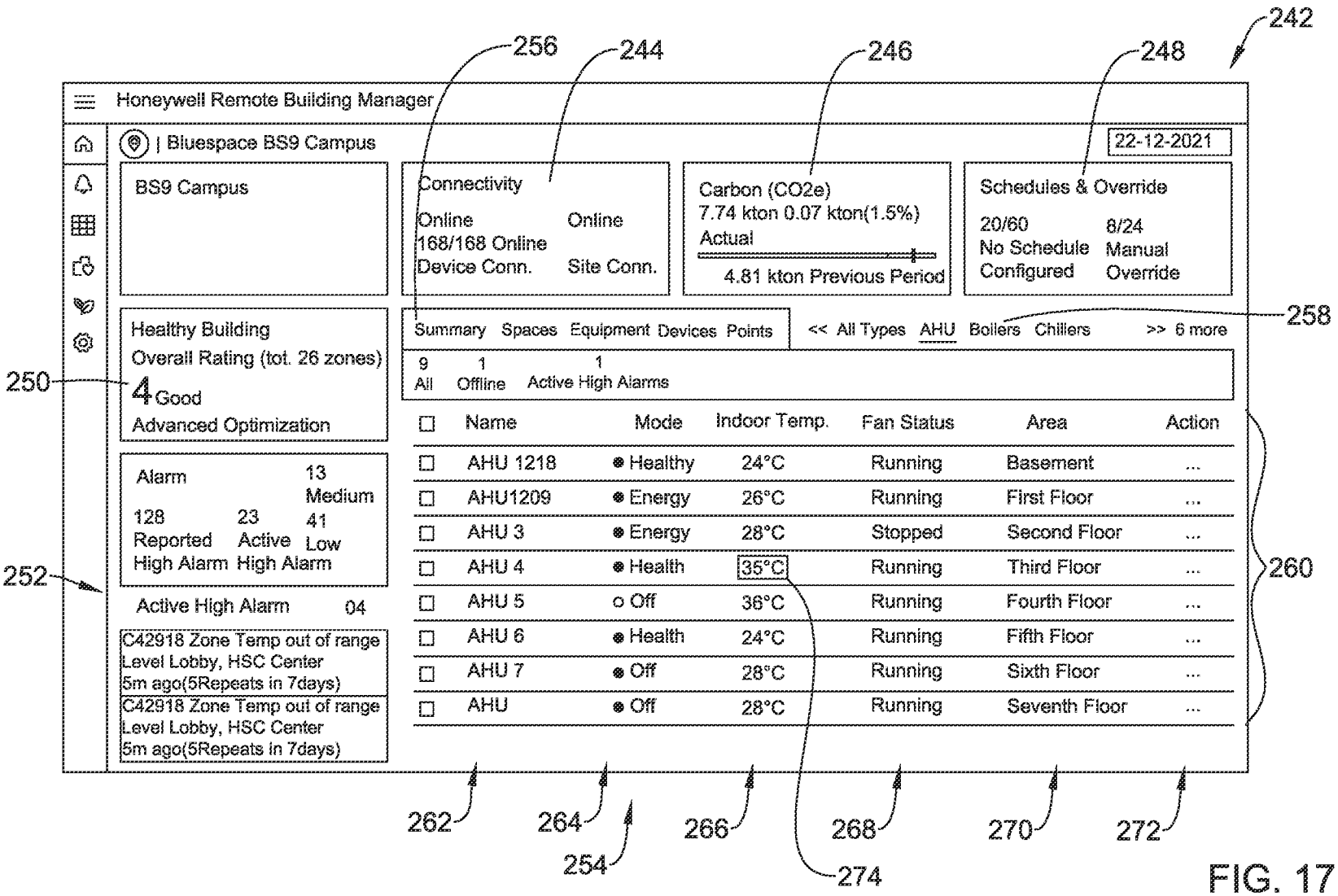

FIG. 17 shows a screen 242 that may be generated and displayed by the HVAC control system 10. The screen 242 includes information for a particular site, in this case, a site named "B S9 Campus". Across an upper portion of the screen 242, the screen 242 includes a Connectivity card 244 that provides a summary of device connectivity, a Carbon/Energy/Energy Usage Intensity (EUI) card 246 that provides a graphical representation of carbon, energy and EUI usage, and can be toggled between displaying carbon, energy and EUI usage, and a schedules and override card 248 that shows at a glance how many sites are either running without a schedule, or are on a manual override. Across a left side of the screen 242, the screen 242 includes a healthy building card 250 that may include an overall portfolio score, a listing of ranked sites, and a summary of the ranked sites. The screen 242 includes an alarms card 252 that includes a summary of how many active alarms there currently are across the portfolio, including a breakdown of how many high priority alarms, medium priority alarms and low priority alarms. The alarms card 252 also includes a listing of the sites (e.g. facilities) with active alarms.

The screen 242 also includes a detail section 254 including a first menu bar 256 that may be used to toggle between Summary, Spaces, Equipment, Devices and Points. As shown, Equipment has been selected. The detail section 254 also includes a second menu bar 258 that may be used to toggle between All Types, AHU, Boilers, Chillers and others (not shown on screen). As shown, AHU is selected. The detail section 254 includes a listing 260 that, because of the selections made in the first menu bar 256 and the second menu bar 258, including a listing of AHUs by name in a column 262, a listing of Mode in a column 264, a listing of Indoor Temperature in a column 266, a listing of Fan Status in a column 268, a listing of Area (where the particular AHU is located) in a column 270 and a listing of Actions in a column 272, although the column 272 is not currently populated. As can be seen, several AHUs are currently operating in a health mode, several are operating in an energy mode and several AHUs are currently off. The AHU named AHU4, currently running in the health mode, currently has an indoor temperature 274 that is outside of range. The temperature 274 is easily seen by virtue of being highlighted, such as by displaying the temperature 274 within a red box, although other colors may be used.

In the example shown, column 264 shows the current operating mode of each of the corresponding AHU's, and also includes a drop down menu for each AHU that allows a user to change the current operating mode to another operating mode. When desired, the user may activate the drop-down menu to display a listing of available operating modes for the corresponding AHU. The user may then pick a desired operating mode from the listing of available operating modes. In response, the corresponding AHU is controlled in accordance with the newly selected operating mode.

Figure 18:
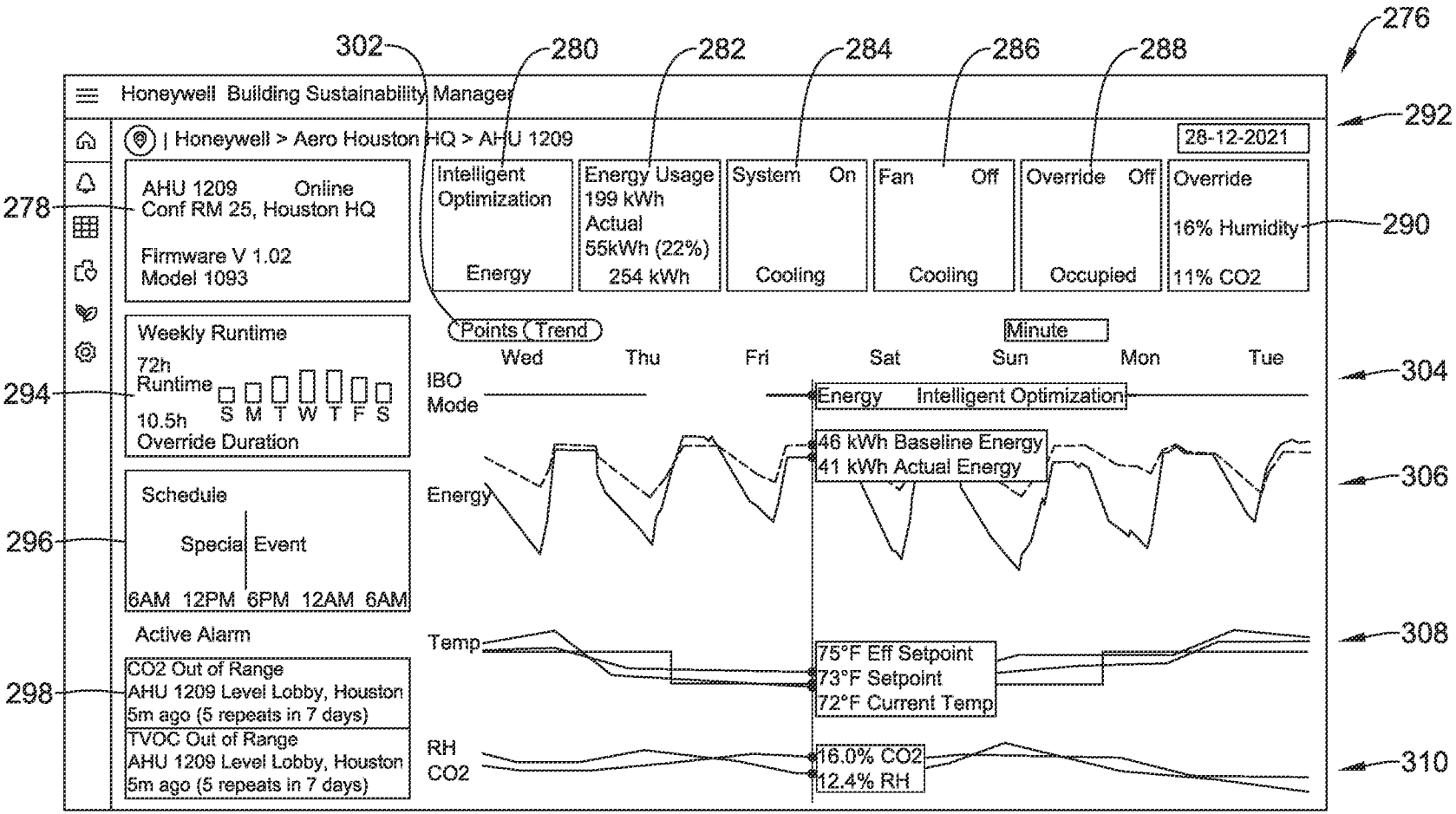

FIG. 18 shows a screen 276 that may be generated and displayed by the HVAC control system 10 in response to a user requesting to drill down on a particular AHU as shown in the screen 242. In particular, the screen 276 provides additional information pertaining to the AHU named AHU 1209, which as seen in the screen 242 is currently running in an energy mode. This provides an example of the user being able to drill down on a particular piece of equipment. Across an upper portion of the screen 276, the screen 276 includes an Equipment card 278 that provides an easy way to see which piece of equipment is being displayed. The screen 276 includes an Intelligent Optimization widget 280, an Energy Usage widget 282, a System Status widget 284, a Fan Status widget 286, an Override widget 288 and an Occupancy widget 290. The screen 276 includes a calendar bar 292 that lets a user select a particular time period, starting at a starting date and/or time to an ending date and/or time. Along a left side, the screen 276 includes a Weekly Runtime card 294 that provides runtime information, a Schedule card 296 that provides scheduling information, and an Active Alarms card 298 that includes a listing of active alarms and what they are.

The screen 276 includes a graphical section 300 that displays additional information pertaining to the AHU 1209. The graphical section 300 includes a menu bar 302 that may be used to toggle between displaying data trends or points. As shown, Trend has been selected. The graphical section 300 includes an IBO Mode section 304 that shows, for the selected and displayed date range, what mode the AHU 1209 was operating in. In some cases, different colors may be used to quickly identify the operating mode. For example, on December 22 and December 23, the AHU 1209 was operating in the balanced mode, as indicated by a particular color such as purple. Starting December 24, the AHU 1209 was being operated in the energy mode, as indicated by a particular color such as yellow. In some cases, additional energy modes, such as Energy1, Energy2 and Energy3 may be indicated by particular colors such as darker shades of yellow. Starting December 27, the AHU 1209 was operated in a health mode, as indicated by a particular color such as green.

The graphical section 300 includes an energy section 306 that provides a graphical representation of both actual energy consumption and baseline energy for the selected time period. In some cases, the actual energy consumption may graphed using a first line pattern or a particular color such as blue and the baseline energy may be graphed using a second, different, line pattern, or a particular color such as gray. The graphical section 300 includes a temperature section 308 that may include setpoint information, EFF Setpoint information and current temperature, each graphed using a unique line pattern and/or particular color. The graphical section 300 also includes an IAQ section 310 that may include $CO_2$ values and relative humidity (rH) values, each graphed over the selected time period, and each graphed using a unique line pattern and/or particular color.

As can be seen, the trend graphs include historical information, wherein the historical information may include one or more of a historical energy usage of the selected HVAC component (e.g. AHU) and a historical sensed value for the building space serviced by the selected HVAC component. As an example, the historical sensed value may include one or more of a historical sensed temperature value, a historical sensed humidity value, a historical sensed $CO_2$ value, a historical sensed PM2.5 value and a historical sensed TVOC value for the building space serviced by the selected HVAC component. In some cases, the historical information may include a historical operating mode of the selected one of the two or more of the plurality of HVAC components as described above.

Figure 19:
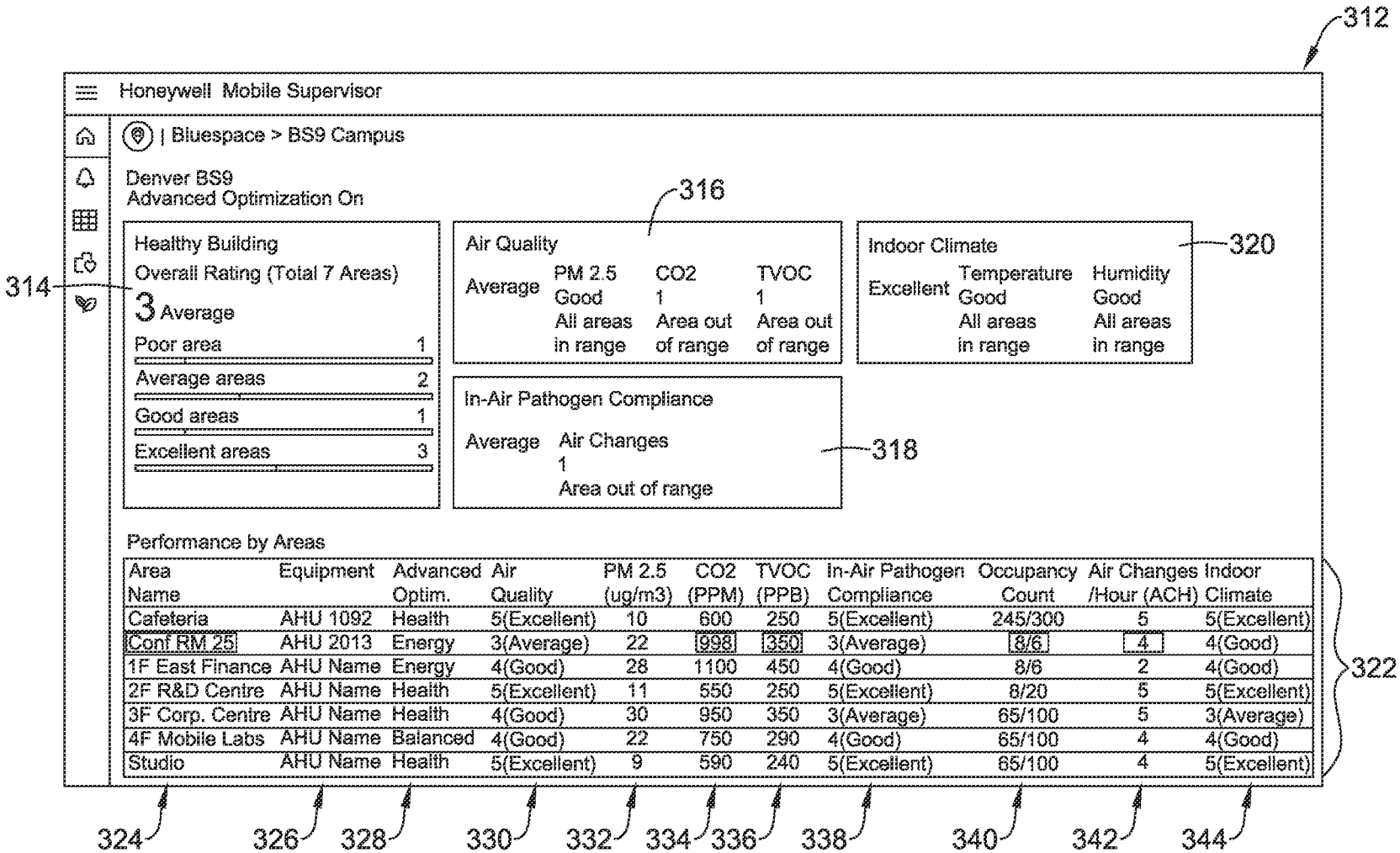

FIG. 19 shows a screen 312 that may be generated and displayed by the HVAC control system 10 for a user at a facility manager level. The screen 312 may provide the facility manager with the ability to view a healthy building rating/score along with an in-air pathogen compliance rating/score In some cases, the screen 312 may provide real-time or near real-time data for the healthy building rating/score. The screen 312 includes a healthy building card 314 that provides an overall building health rating/score (on a scale of 1-5) and some information as to why the overall building health rating/score is what it is. The screen 312 includes an Air Quality card 316 that provides current readings for particulate matter, carbon dioxide and total volatile organic compounds. The screen 312 includes an In-Air Pathogen Compliance card 318 that shows air exchange compliance. An Indoor Climate card 320 provides a summary of temperature and humidity values for each of one or more areas, rooms or spaces within the particular facility displayed.

The screen 312 includes a listing 322 that shows performance by area. The listing 322 includes a column 324 showing area names, a column 326 showing specific equipment, a column 328 showing optimization mode, a column 330 showing air quality, a column 332 showing PM2.5 values, a column 334 showing $CO_2$ values, a column 336 showing TVOC values, a column 338 showing In-Air Pathogen Compliance, a column 340 showing occupancy values relative to capacity or planned occupancy, a column 342 showing a number of air exchanges per hour, and a column 344 showing indoor climate values.

In some cases, values that are out of range may be highlighted. As shown, Conference Room 25 currently has a $CO_2$ concentration of 998 ppm (parts per million), a TVOC concentration of 250 ppb (parts per billion), an occupancy count of 8 (relative to a capacity or planned occupancy of 6) and is currently undergoing 4 air exchanges per hour. The increasing IAQ values are likely a result of having 8 people in a space that is planned for only 6 people. Solutions may include reducing the number of people in the room and/or increasing the ventilation rate to the room.

Figure 20:
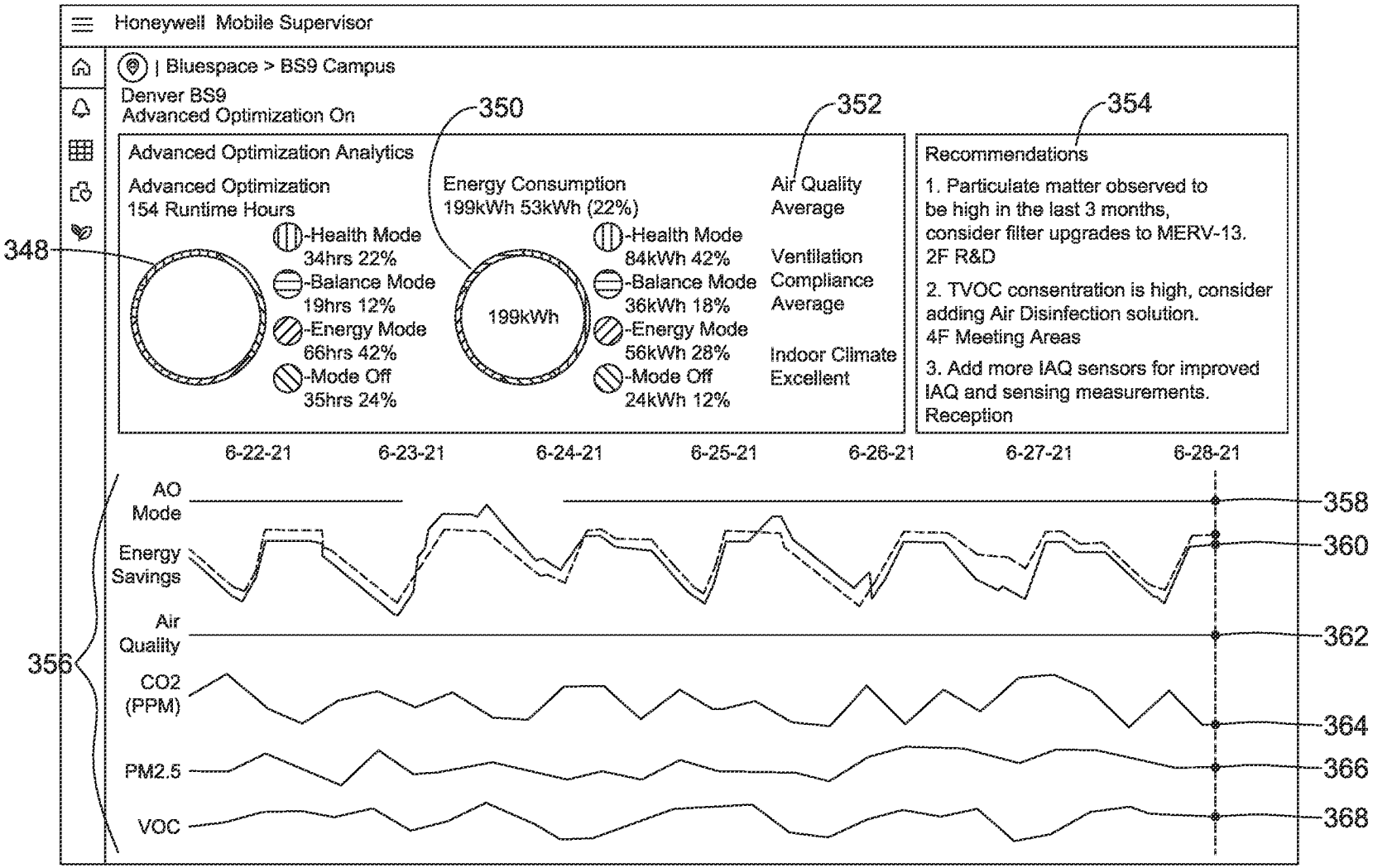

FIG. 20 shows a screen 346 that may be generated and displayed by the HVAC control system 10 for a user at a facility manager level. The screen 346 may enable the facility manager to visualize and analyze IAQ, energy consumption, modes of operation, facility run time, and performance over different time periods, and allow the facility manager to take strategic control for immediate and long-term gains in terms of utility, expenses and enhanced air quality. Strategic control may include manual control. Strategic control may include automatic control.

The screen 346 provides information pertaining to advanced optimization analytics. The screen 346 includes a runtime card 348 that provides an indication of the time spent operating in each of the various modes (health mode, balance mode, an energy mode or off mode). The screen 346 includes an energy consumption card 350 that shows total energy consumption and also shows relative energy consumption for the time spent in each of the various operating modes. The screen 346 includes an air quality card 352. The screen 346 includes a recommendations card 354 that may include recommendations made at an equipment level, a room level, a zone level, a site level or even a portfolio level. As shown, the recommendations card 354 suggests a filter upgrade, an air disinfection solution and the addition of more IAQ sensors. The screen 346 includes a graphical section 356 that includes many of the categories shown previously in FIG. 18, for example. The graphical section 356 includes an operating mode section 358, an energy savings section 360, an air quality section 362, a $CO_2$ section 364, a PM2.5 section 366 and a VOC section 368.

Figure 21:
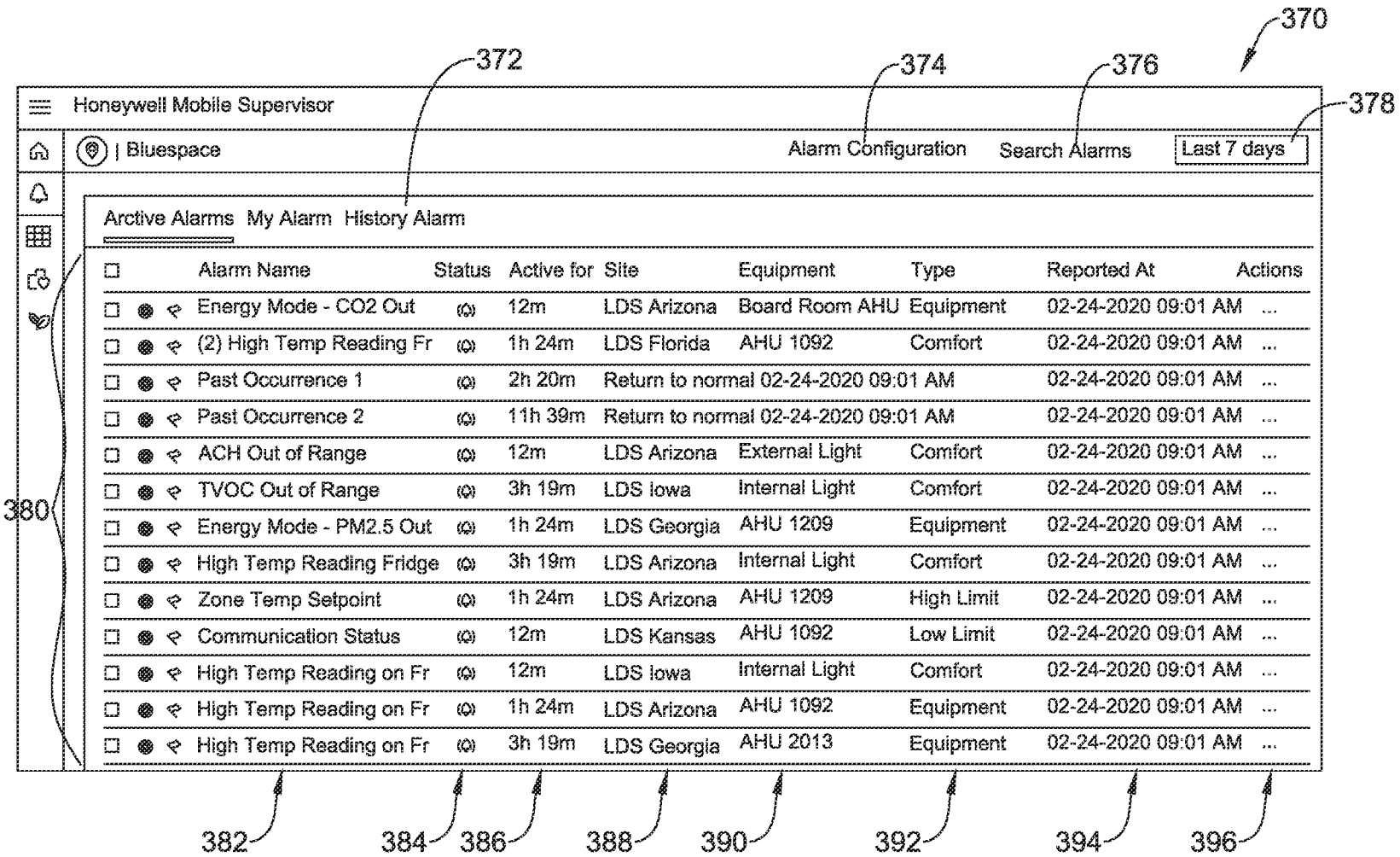

FIG. 21 shows a screen 370 that may be generated and displayed by the HVAC control system 10 that provides a substantial amount of alarm information. The screen 370 includes a menu bar 372 that may be used to toggle between listing Active Alarms, My Alarms, or Alarm History. As shown, Active Alarm has been selected. The screen 370 includes an Alarm Configuration button 374 that may be used to configure one or more alarms, a Search Alarms button 376 that may be used to search for a particular alarm, for example, and a pull-down menu 387 that may be used to select a particular time frame. As shown, a time period equal to the last 7 days has been selected.

The screen 370 includes a listing 380 of alarms. The listing 380 of alarms includes a column 382 showing alarm names, a column 384 showing an alarm status icon, a column 386 showing alarm duration values, a column 388 showing where the alarms are, a column 390 showing what equipment is affected, a column 392 showing a type of alarm, a column 394 showing when the alarms were reported, and a column 396 showing actions, although the column 396 is not currently populated.

Figure 22:
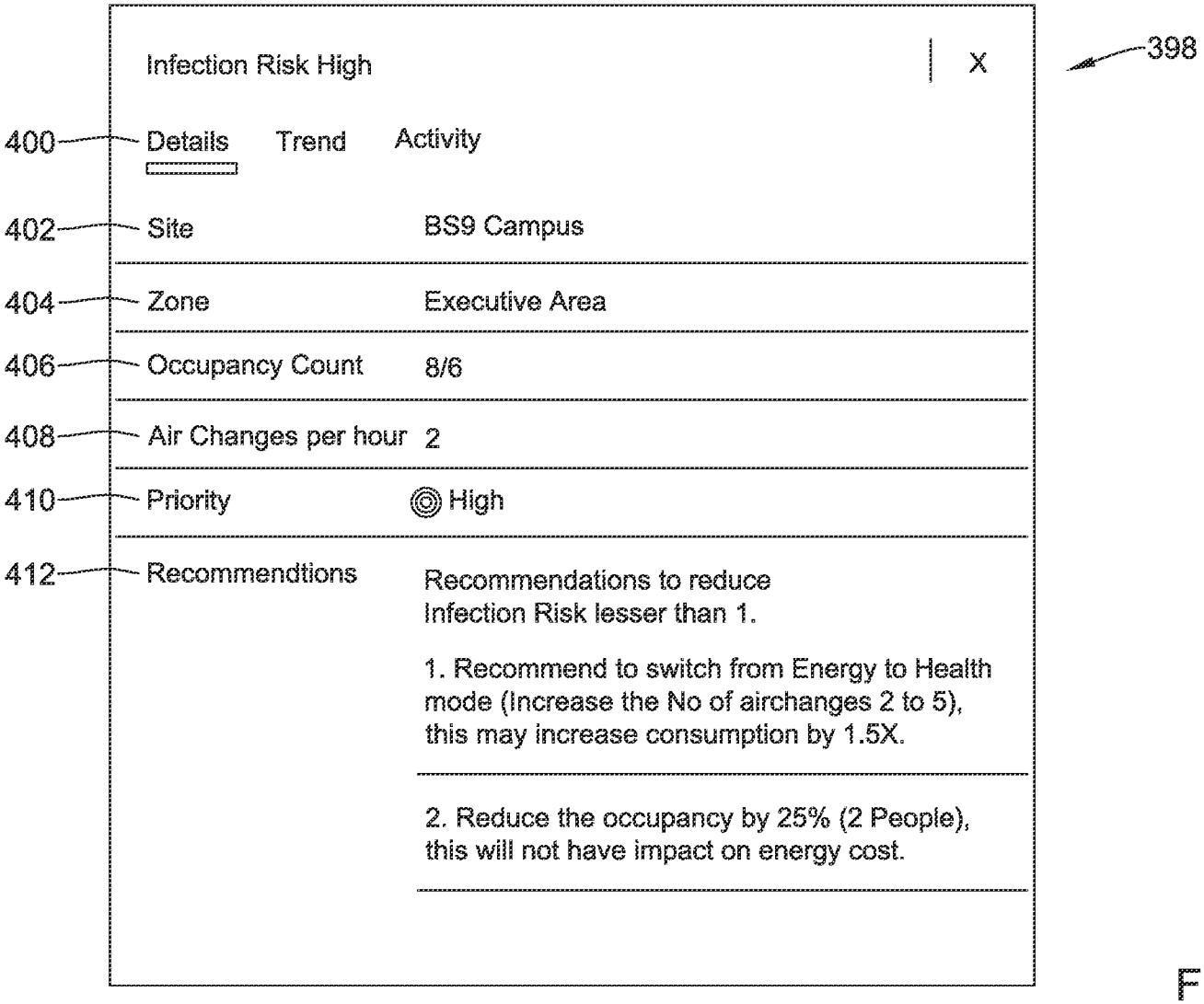

FIG. 22 shows a screen 398 that may be generated and displayed by the HVAC control system 10. The screen 398 includes information pertaining to current infection risk alarm, and may be considered as representing the Conference Room 25 as shown in FIG. 19. The screen 398 includes a menu bar 400 that may be used to select between Details, Trend and Activity. As shown, Details has been selected. The screen 398 includes a site section 402, a zone section 404, an occupancy count section 406, current air changes per hour section 408, a priority section 410 and a Recommendations section 412. The Recommendations section 412 includes two suggestions, including switching from energy mode to health mode, which translates to increasing the number of air changes per hour from 2 to 5, and reducing the occupancy by 25% (reducing from 8 people to 6 people). The recommendation may include a recommended action and a prediction of an increase in energy consumption by the HVAC system if the recommended action is taken (e.g. "this may increase consumption by 1.5×).

Additional features of dynamic ventilation may be found in U.S. Ser. No. 17/751,009, filed Jan. 7, 2022 and entitled DYNAMIC VENTILATION COTNROL FOR A BUILDING, which application is incorporated by reference herein in its entirety.

Having thus described several illustrative embodiments of the present disclosure, those of skill in the art will readily appreciate that yet other embodiments may be made and used within the scope of the claims hereto attached. It will be understood, however, that this disclosure is, in many respects, only illustrative. Changes may be made in details, particularly in matters of shape, size, arrangement of parts, and exclusion and order of steps, without exceeding the scope of the disclosure. The disclosure's scope is, of course, defined in the language in which the appended claims are expressed.

What is claimed is:

1. A method for operating a Heating, Ventilating and Air Conditioning (HVAC) system that services a building space, the method comprising:

sensing one or more sensed values;

automatically selecting an operating mode of the HVAC system from a plurality of operating modes based at least in part on one or more of the sensed values, wherein the plurality of operating modes include:

a health mode that when selected is configured to maximize ventilation to the building space subject to one or more constraints including a constraint of maintaining one or more comfort conditions in the building space;

a first energy savings mode that is configured to minimize energy consumed by the HVAC system to condition air supplied to the building space subject to one or more constraints including a constraint of maintaining one or more comfort conditions in the building space and a constraint to maintain indoor air quality (IAQ) contaminants in the building space below one or more first IAQ thresholds;

a second energy savings mode that is configured to minimize energy consumed by the HVAC system to condition air supplied to the building space subject to one or more constraints including a constraint of maintaining one or more comfort conditions in the building space and a constraint to maintain IAQ contaminants in the building space below one or more second IAQ thresholds, wherein the one or more second IAQ thresholds are greater than the one or more first IAQ thresholds; and controlling one or more components of the HVAC system in accordance with the selected operating mode.

2. The method of claim 1, further comprising:

automatically switching from the first energy savings mode to the second energy savings mode when the constraint of maintaining one or more comfort conditions in the building space cannot be achieved in the first energy savings mode.

3. The method of claim 1, further comprising: automatically switching from the first energy savings mode to the second energy savings mode when the constraint of maintaining IAQ contaminants in the building space below the one or more first IAQ thresholds cannot be achieved in the first energy savings mode.

4. The method of claim 1, wherein the plurality of operating modes comprise: a balanced mode that when selected is configured to control ventilation to the building space to maintain IAQ contaminants in the building space below one or more balance mode IAQ thresholds subject to one or more constraints including a constraint of maintaining one or more comfort conditions in the building space.

5. The method of claim 1, wherein the plurality of operating modes further include: a third energy savings mode that is configured to minimize energy consumed by the HVAC system to condition air supplied to the building space subject to one or more constraints including a constraint of maintaining one or more comfort conditions in the building space and a constraint to maintain IAQ contaminants in the building space below one or more third IAQ thresholds, wherein the one or more third IAQ thresholds are greater than the one or more second IAQ thresholds.

6. The method of claim 5, wherein the plurality of operating modes further include: a fourth energy savings mode that is configured to minimize energy consumed by the HVAC system to condition air supplied to the building space subject to one or more constraints including a constraint of maintaining one or more comfort conditions in the building space and a constraint to maintain IAQ contaminants in the building space below one or more fourth IAQ thresholds, wherein the one or more fourth IAQ thresholds are greater than the one or more third IAQ thresholds.

7. The method of claim 1, wherein the IAQ contaminants comprise $CO_2$, PM2.5 and TVOC, each with a corresponding first IAQ threshold and a corresponding second IAQ threshold.

8. The method of claim 1, wherein the one or more sensed values comprise two or more of an energy meter reading value, an indoor temperature value, an outdoor temperature value, an indoor humidity value, an outdoor humidity value, an indoor dew point value, an outdoor dew point value, a pressure value, an indoor $CO_2$ value, an outdoor $CO_2$ value, an indoor PM2.5 value, an outdoor PM2.5 value, an indoor TVOC value and an outdoor TVOC value, an occupancy value.

9. The method of claim 1, further comprising:

predicting a ventilation setpoint for a fresh air intake of the HVAC system that provides ventilation to the building space using a ventilation setpoint prediction algorithm;

predicting an energy consumption baseline of the HVAC system with the fresh air intake at the predicted ventilation setpoint;

predicting a concentration of one or more IAQ contaminates in the building space with the fresh air intake at the predicted ventilation setpoint;

controlling the fresh air intake of the HVAC system to the predicted ventilation setpoint;

with the fresh air intake of the HVAC system at the predicted ventilation setpoint, determining a residual between the predicted concentration of one or more IAQ contaminates and a measured concentration of one or more IAQ contaminates in the building space; and feeding back the residual between the predicted concentration of one or more IAQ contaminates and the measured concentration of one or more IAQ contaminates to the ventilation setpoint prediction algorithm, wherein the ventilation setpoint prediction algorithm uses the residual to improve prediction accuracy of the ventilation setpoint over time.

10. The method of claim 1, wherein while operating in the first energy savings mode, increasing ventilation to the building space at times when ventilation has a reduced impact on energy consumed by the HVAC system, and decreasing ventilation to the building space at times when ventilation has an increased impact on energy consumed by the HVAC system.

11. The method of claim 1, wherein while operating in the first energy savings mode, increasing ventilation to the building space at times when one or more outdoor air parameters have a reduced impact on energy consumed by the HVAC system and/or an increased impact on reducing concentrations of one or more IAQ contaminates in the building space, and decreasing ventilation to the building space at times when one or more outdoor air parameters have an increased impact on energy consumed by the HVAC system and/or a decreased impact on reducing concentrations of one or more IAQ contaminates in the building space.

12. A Heating, Ventilating and Air Conditioning (HVAC) system configured to service a building space, the HVAC system comprising:

one or more HVAC components including at least one damper;

a plurality of sensors configured to sense one or more sensed values;

a controller having an input, for receiving the one or more sensed values from the plurality of sensors including one or more interior or exterior environmental conditions, and a processor configured to perform a method comprising:

receiving the one or more sensed values;

automatically selecting an operating mode of the HVAC system from a plurality of operating modes based at least in part on one or more of the sensed values, wherein the plurality of operating modes include:

a health mode that when selected is configured to maximize ventilation to the building space subject to one or more constraints including a constraint of maintaining one or more comfort conditions in the building space;

a first energy savings mode that is configured to minimize energy consumed by the HVAC system to condition air supplied to the building space subject to one or more constraints including a constraint of maintaining one or more comfort conditions in the building space and a constraint to maintain IAQ contaminants in the building space below one or more first IAQ thresholds;

a second energy savings mode that is configured to minimize energy consumed by the HVAC system to condition air supplied to the building space subject to one or more constraints including a constraint of maintaining one or more comfort conditions in the building space and a constraint to maintain IAQ contaminants in the building space below one or more second IAQ thresholds, wherein the one or more second IAQ thresholds are greater than the one or more first IAQ thresholds; and controlling the one or more HVAC components in accordance with the selected operating mode.

13. The HVAC system of claim 12, wherein the processor is further configured to automatically switch from the first energy savings mode to the second energy savings mode when the constraint of maintaining one or more comfort conditions in the building space cannot be achieved in the first energy savings mode.

14. The HVAC system of claim 12, wherein the processor is further configured to automatically switch from the first energy savings mode to the second energy savings mode when the constraint of maintaining IAQ contaminants in the building space below the one or more first IAQ thresholds cannot be achieved in the first energy savings mode.

15. The HVAC system of claim 12, wherein the plurality of operating modes comprise a balanced mode that when selected is configured to control ventilation to the building space to maintain IAQ contaminants in the building space below one or more balance mode IAQ thresholds subject to one or more constraints including a constraint of maintaining one or more comfort conditions in the building space.

16. The HVAC system of claim 12, wherein the plurality of operating modes comprise a third energy savings mode that is configured to minimize energy consumed by the HVAC system to condition air supplied to the building space subject to one or more constraints including a constraint of maintaining one or more comfort conditions in the building space and a constraint to maintain IAQ contaminants in the building space below one or more third IAQ thresholds, wherein the one or more third IAQ thresholds are greater than the one or more second IAQ thresholds.

17. The HVAC system of claim 12, wherein the IAQ contaminants comprise $CO_2$, PM2.5 and TVOC, each with a corresponding first IAQ threshold and a corresponding second IAQ threshold.

18. The HVAC system of claim 12, wherein the one or more sensed values comprise two or more of an energy meter reading value, an indoor temperature value, an outdoor temperature value, an indoor humidity value, an outdoor humidity value, an indoor dew point value, an outdoor dew point value, a pressure value, an indoor $CO_2$ value, an outdoor $CO_2$ value, an indoor PM2.5 value, an outdoor PM2.5 value, an indoor TVOC value and an outdoor TVOC value, an occupancy value.

19. The HVAC system of claim 12, wherein the processor is further configured to:

predict a ventilation setpoint for a fresh air intake of the HVAC system that provides ventilation to the building space using a ventilation setpoint prediction algorithm;

predict an energy consumption baseline of the HVAC system with the fresh air intake at the predicted ventilation setpoint;

predict a concentration of one or more IAQ contaminates in the building space with the fresh air intake at the predicted ventilation setpoint;

control the fresh air intake of the HVAC system to the predicted ventilation setpoint;

with the fresh air intake of the HVAC system at the predicted ventilation setpoint, determine a residual between the predicted concentration of one or more IAQ contaminates and a measured concentration of one or more IAQ contaminates in the building space; and feed back the residual between the predicted concentration of one or more IAQ contaminates and the measured concentration of one or more IAQ contaminates to the ventilation setpoint prediction algorithm, wherein the ventilation setpoint prediction algorithm uses the residual to improve prediction accuracy of the ventilation setpoint over time.

20. The HVAC system of claim 12, wherein the processor is further configured to, while operating in the first energy savings mode, increase ventilation to the building space at times when ventilation has a reduced impact on energy consumed by the HVAC system, and decreasing ventilation to the building space at times when ventilation has an increased impact on energy consumed by the HVAC system.

* * * * *